US005435954A

United States Patent [19]

Wold

[11] Patent Number: 5,435,954

[45] Date of Patent: Jul. 25, 1995

[54] METHOD FOR FORMING ARTICLES OF REINFORCED COMPOSITE MATERIAL

[75] Inventor: Ted H. Wold, Winnfield, La.

[73] Assignee: Riverwood International Corporation, Atlanta, Ga.

[21] Appl. No.: 134,175

[22] Filed: Oct. 8, 1993

[51] Int. Cl.[6] ..... B27N 3/08

[52] U.S. Cl. ..... 264/115; 264/113; 264/119; 264/122; 264/126; 428/903.3

[58] Field of Search ..... 264/109, 112, 113, 115, 264/119, 122, 125, 126, 116; 428/903.3

[56] References Cited

U.S. PATENT DOCUMENTS

| | | | |
|---|---|---|---|
| Re. 30,636 | 6/1981 | Barnes | 428/294 |
| 3,104,085 | 9/1963 | Skladany | 248/119 |
| 3,146,285 | 8/1964 | Munk | 264/266 |
| 3,164,511 | 1/1965 | Elmendorf | 161/57 |
| 3,187,691 | 6/1965 | Leitzel | 108/58 |
| 3,354,248 | 11/1967 | Haas et al. | 264/119 |
| 3,359,929 | 12/1967 | Carlson | 108/58 |
| 3,391,233 | 7/1968 | Polovtseff | 264/113 |
| 3,435,784 | 4/1969 | Petersen | 108/51 |
| 3,611,952 | 10/1971 | Hoffman | 108/51 |
| 3,671,615 | 6/1972 | Price | 264/39 |
| 3,720,176 | 3/1973 | Munroe | 108/58 |
| 3,806,562 | 4/1974 | Lamort et al. | 264/31 |
| 3,940,230 | 2/1976 | Potter | 425/451 |
| 4,053,004 | 10/1977 | Barwise et al. | 144/162 |
| 4,061,813 | 12/1977 | Geimer et al. | 428/183 |
| 4,073,851 | 2/1978 | Munk | 264/109 |
| 4,078,030 | 3/1978 | Munk et al. | 264/109 |
| 4,084,966 | 4/1978 | Hass et al. | 96/1 |
| 4,131,664 | 12/1978 | Flowers et al. | 264/89 |
| 4,131,705 | 12/1978 | Kubinsky | 428/106 |
| 4,203,755 | 5/1980 | Ruckstuhl | 71/9 |
| 4,221,751 | 9/1980 | Hastaja et al. | 264/119 |
| 4,230,049 | 10/1980 | Horne | 108/51 |
| 4,241,133 | 12/1980 | Lund et al. | 428/326 |
| 4,248,163 | 2/1981 | Caughey | 108/53 |
| 4,248,820 | 2/1981 | Haataja | 264/113 |
| 4,267,137 | 5/1981 | Smith | 264/113 |
| 4,303,019 | 12/1981 | Haataja et al. | 108/51 |
| 4,318,351 | 3/1982 | Munk | 108/51 |
| 4,337,710 | 7/1982 | Haataja et al. | 108/53 |
| 4,337,710 | 7/1982 | Haataja et al. | 108/53.3 |
| 4,339,040 | 7/1982 | Peil et al. | 206/559 |
| 4,358,418 | 11/1982 | Heggenstaller | 264/108 |
| 4,364,984 | 12/1982 | Wentworth | 428/106 |
| 4,385,564 | 5/1983 | Heggenstaller | 108/51 |
| 4,408,544 | 10/1983 | Haataja | 108/53 |
| 4,440,708 | 4/1984 | Haataja et al. | 264/109 |
| 4,454,940 | 6/1984 | Ufermana | 198/374 |
| 4,467,728 | 8/1984 | Horne | 108/51 |
| 4,469,216 | 9/1984 | Haataja et al. | 198/382 |
| 4,470,498 | 9/1984 | Lund et al. | 198/382 |
| 4,478,896 | 10/1984 | Barnes et al. | 427/421 |
| 4,508,772 | 4/1985 | Churchland et al. | 428/106 |
| 4,517,148 | 5/1985 | Churchland | 264/112 |
| 4,559,194 | 12/1985 | Hegenstaller | 264/113 |
| 4,559,195 | 12/1985 | Heggenstaller | 264/120 |
| 4,563,237 | 1/1986 | Churchland et al. | 156/62 |
| 4,610,913 | 9/1986 | Barnes | 428/215 |
| 4,674,414 | 6/1987 | Nuelle et al. | 108/53 |
| 4,705,472 | 11/1987 | Heggenstaller | 425/261 |
| 4,706,799 | 11/1987 | Churchland et al. | 198/457 |
| 4,751,131 | 6/1988 | Barnes | 428/215 |
| 4,790,966 | 12/1988 | Sandberg et al. | 264/39 |
| 4,872,544 | 10/1989 | Churchland et al. | 198/382 |
| 4,960,553 | 10/1990 | DeBruise et al. | 264/113 |
| 5,096,765 | 3/1992 | Barnes | 428/106 |
| 5,096,945 | 3/1992 | Sun | 524/13 |
| 5,100,601 | 3/1992 | Heggenstaller et al. | 264/113 |
| 5,123,359 | 6/1992 | Delbalso | 108/51 |
| 5,142,994 | 9/1992 | Sandberg et al. | 108/53 |

*Primary Examiner*—Robert A. Dawson
*Assistant Examiner*—Kenneth M. Jones

[57] ABSTRACT

A method for producing articles comprised of reinforced composite materials including primarily wood or cellulosic fiber and plastic is disclosed.. The wood fibers are comminuted to substantially a specific thickness and classified according to length. Plastic is comminuted and mixed with wood fibers to form a reinforced composite mixture in predetermined ratios. The composite materials form the main structural or bonding components of the finished article. Other chemicals, such as a coupler can be added, as can other structural components, such as fiberglass. The mixture is deposited onto a mold when forming articles having deep drawn portions, and subjected to sufficient temperature and pressure to cause the composite mixture substantially to assume the mold form. The process variables disclosed can be selectively modified to produce predetermined physical characteristics in the finished article, such as strength, thickness or prestressed qualities. An article produced by the above process also is disclosed.

30 Claims, 7 Drawing Sheets

METHOD FOR FORMING ARTICLES OF REINFORCED COMPOSITE MATERIAL

FIELD OF THE INVENTION

This invention relates to methods of forming or molding articles comprised of reinforced composite material. The methods are-especially adapted to utilize waste wood and waste plastic as the primary structural components of the formed article. The methods contemplate additional embodiments in which the cellulosic wood fibers are selected within a range of lengths and thicknesses, and aligned in a predetermined direction to achieve the desired strength characteristics and other intended qualities of the finished article. Many other embodiments are disclosed which allow the methods to be altered or enhanced in order to achieve other desired characteristics in the finished article.

BACKGROUND OF THE INVENTION

The use of wood fibers, especially fibers from waste wood, is well known in the formation of articles such as oriented strand board (OSB) and particleboard. An OSB product is disclosed in U.S. Pat. No. 3,164,511 to Elmendorf, which suggests binding strands of wood with urea, phenol and melamine resin. One drawback of the process used to produce OSB products, however, is the high pressures required to form the OSB product. The OSB product, while suited for planar sheets for use as decking, is not ideally suited for use in the formation of articles having deep drawn or formed portions. Additionally, the wood fiber or strand thickness and length ranges permitted in OSB products render this product unsuitable for articles in which stresses must be uniformly transmitted throughout its structural matrix. The variations in fiber thickness and length of OSB creates high pressure and low pressure areas unsuitable for articles subjected to bending stresses. Further, OSB technology, as disclosed in U.S. Pat. No. 3,164,511, discourages the use of strands shorter than one-half inch or longer than 6 inches. Particleboard, formed similarly to OSB but using wood fines rather than strands as its main structural component, is very dense and brittle, and also requires very high pressure in its formation. The structural limitations associated with particleboard render it unsuitable for shaped, non-planar articles intended to withstand significant load stresses.

Other methods have been developed to utilize wood fiber in making shaped articles having drawn portions, such as pallets used in material handling, rather than planar articles such as decking. Such pallets normally include a flat support surface with either shallow or deep drawn legs projecting downwardly therefrom. Various such methods are known, and disclosed, for example, in the following U.S. Pat. Nos. 4,221,751, 4,248,163, 4,440,708, 4,960,553, and 5,142,994. These references disclose using either papermill sludge, the solid residue of wood fibers and filler, such as clay or wood fibers from other sources. The wood fibers disclosed in these references typically are bonded using thermosetting resins such as phenolformaldehyde, resorcinol-formaldehyde, melamine-formaldehyde, urea-formaldehyde, urea-furfural and condensed furfuryl alcohol resin and organic polyisocyanates, either alone or in combination. The use of isocyanates as the bonding agent in these articles normally prevents the mixture of wood fibers having different densities as the main structural components, since such bonding agents are very density dependent when used in such a process. This is an acute disadvantage in a system that must use waste wood from many different sources as a principal structural component. The use of these binding agents also has drawbacks such as contributing to the environmental waste stream, forming shaped products which are susceptible to moisture degradation, and forming products which do not have uniform strength characteristics throughout their load bearing portions.

Molded pallets and platforms also have been developed which, to some extent, utilize plastic, either as a coating over a cellulosic fiber matrix, or as an additive to wood pulp slurry, such as disclosed in U.S. Pat. Nos. 3,187,691 and 4,230,049. While the products produced thereby may achieve better moisture resistance characteristics than molded articles using other binding agents, such articles nevertheless suffer either from the strength limitations referenced above, or require an intricate and complex forming process. In some situations, plastic is added only as a coating in the final forming stages of the article, and thus does not impart significant bonding, strength, and other desirable characteristics achieved when plastic is used as a primary structural component as well as a bonding agent.

Accordingly, it is believed that a need yet remains for a method of forming a shaped article with specific and selective strength characteristics in which stresses on the article are transmitted substantially throughout the mat matrix, and in which the article includes additional characteristics such as ease in formation, ability to be formed into deep drawn shapes while maintaining its strength characteristics, and being resistant to degradation caused by moisture, insects and microbes.

It is also believed that a need remains for such a method which readily can utilize waste products, thus achieving the compound effect of reducing waste handling and landfilling, protecting the environment from waste incineration, and reinjecting used waste products back into a useful product stream. For example, while there is a trend toward recycling plastics, such recycling efforts are severely limited considering that most plastics of different composition cannot be combined to form a higher quality recycled product. Thus the potential known uses for recycled plastic as the main structural component for high grade finished products are relatively limited.

Additionally, the known methods which utilize wood fibers in some capacity to form a finished composite article do not adequately utilize the waste wood supply, which presently is either burned or landfilled. Many of the known methods utilize either papermill sludge as a source for wood fibers or are dependent upon a raw wood supply which is consistent in the same type of wood utilized. That is, known methods do not readily accept waste wood of various types having various densities in the same process due to the bonding agent limitations and structural inconsistencies discussed above.

The present invention overcomes many of these disadvantages by providing a method in which waste wood of varying types can be incorporated into the same product, thus providing for much better utilization of waste wood. Additionally, the present invention incorporates various types of plastics not only as a primary bonding agent but also as a primary structural component, thus also utilizing different types of plastics, which normally are not combinable for molding into a recyclable product. Even the articles manufactured according to the preferred embodiments of the invention can be recycled according to the methods disclosed herein to form "secondary products," so that the raw materials can be reused many times to form useful articles.

SUMMARY OF TEE INVENTION

Briefly described, one form of the present invention comprises a method in which waste wood is comminuted into flakes of cellulosic fibers of a desired and uniform thickness, and classified according to length. Plastics, such as various grades of high density polyethylene (HDPE) or low density polyethylene (LDPE) also are comminuted to a desired size. The cellulosic fibers are combined with the plastic to form a composite mixture. The length of fiber or flake and the type of plastic selected are dependent upon the material characteristics desired in the finished product. Additionally at this blending stage a coupling agent can be added to facilitate the formation of and to enhance the intended properties in the finished article. The composite mixture is then deposited onto a preformed mold, such that the fibers are oriented with their lengths aligned or disposed in a desired direction, to form a mat of composite material on the mold. The mat is then subjected to heat and pressure sufficient to cause the plastic to migrate throughout the fibers, filling substantially all voids and interstices between the fibers. The use of these materials according to this method results in an article having planned structural and material characteristics.

In another embodiment of the present invention, a second layer or mat, either comprised of the first blend of composite material or a second, different blend of composite material, is deposited upon the first mat prior to heating and pressurizing, with the wood fibers aligned at an angle, for example transversely, to the alignment of the fibers of the first mat. Similarly, a third layer or mat can be deposited upon the second mat, with the third mat, for example being comprised of the same blend of materials as that of the first mat. The fibers of the third mat also are selectively aligned in a predetermined position to impart additional strength to the finished article. The three mats or layers then together are subjected to heat and pressure which likewise cause the plastic in the three layers to migrate between the fibers of the various layers forming a composite matrix constituting a tension layer, a core layer, and a compression layer. The systematic and planned orientation of the fiber accomplishes uniform strength properties throughout the mat, and allows load forces directed against the article to be transferred through the fiber and plastic structural matrix, minimizing load failure.

The material characteristics of the finished article also can be enhanced by using fiberglass rovings within the various material blends, especially in the tension and compression layers, when a two or three layer article is formed, as discussed above. The method of forming articles according to the present invention permits the selective altering of many variables or components, thus permitting the article to be precisely engineered to incorporate various desired features. The present method also readily lends itself to the use of waste product for each of its main structural components, which waste product otherwise would pollute the environment. These waste products include waste wood which normally is either burned or landfilled, and waste plastic, which constitutes one of the most environmentally adverse materials due to its resistance to degradation. Thus, the present invention utilizes materials previously considered principally waste byproducts. The present invention, however, is not limited to the use of waste materials. Non-waste or virgin wood fibers, fiberglass and plastics also can be used, if desired.

One of the most important features of this composite technology and the products produced is how the product fails at MOR and beyond the initial rupture point. This characteristic, after initial failure, is a feature that is controllable by changing blend rations, types of plastic, and compression ratios, as discussed above. Unlike currently known products in which failure is abrupt and where 25%–75% of the product's strength is lost completely at initial rupture, products made in accordance with the present invention resist abrupt failure.

Accordingly, it is a primary object of the present invention to provide a method of forming useful articles of a reinforced composite mixture of wood fiber, fiberglass and plastic as the primary structural and bonding agents. The fiberglass is used primarily to enhance bending and tensile strengths.

It is another object of the present invention to provide a method for forming an article comprised of a plastic and cellulosic fiber composite material which is selectively designed to attribute various physical characteristics to the article, such as strength, durability, wear resistance, form and shape.

It is another object of the present invention to provide a method for utilizing materials such as wood, fiberglass and plastic which normally would be retained in the waste product stream and disposed of in an environmentally adverse manner.

It is another object of the present invention to provide a method of forming articles which include cellulosic fibers as a structural component, which method permits the use and blending of fibers of different densities and wood types.

It is another object of the present invention to provide useful articles made in accordance with the methods disclosed herein, such as material handling pallets which are formed having deep drawn leg portions and which support loads by uniformly transferring load stresses throughout the wood fiber and plastic structural matrix.

Other objects, features, and advantages of the present invention will become apparent upon reading the following specification in conjunction with the accompanying drawing figures.

DETAILED DESCRIPTION OF THE PREFERRED EMBODIMENT

Figure 1:
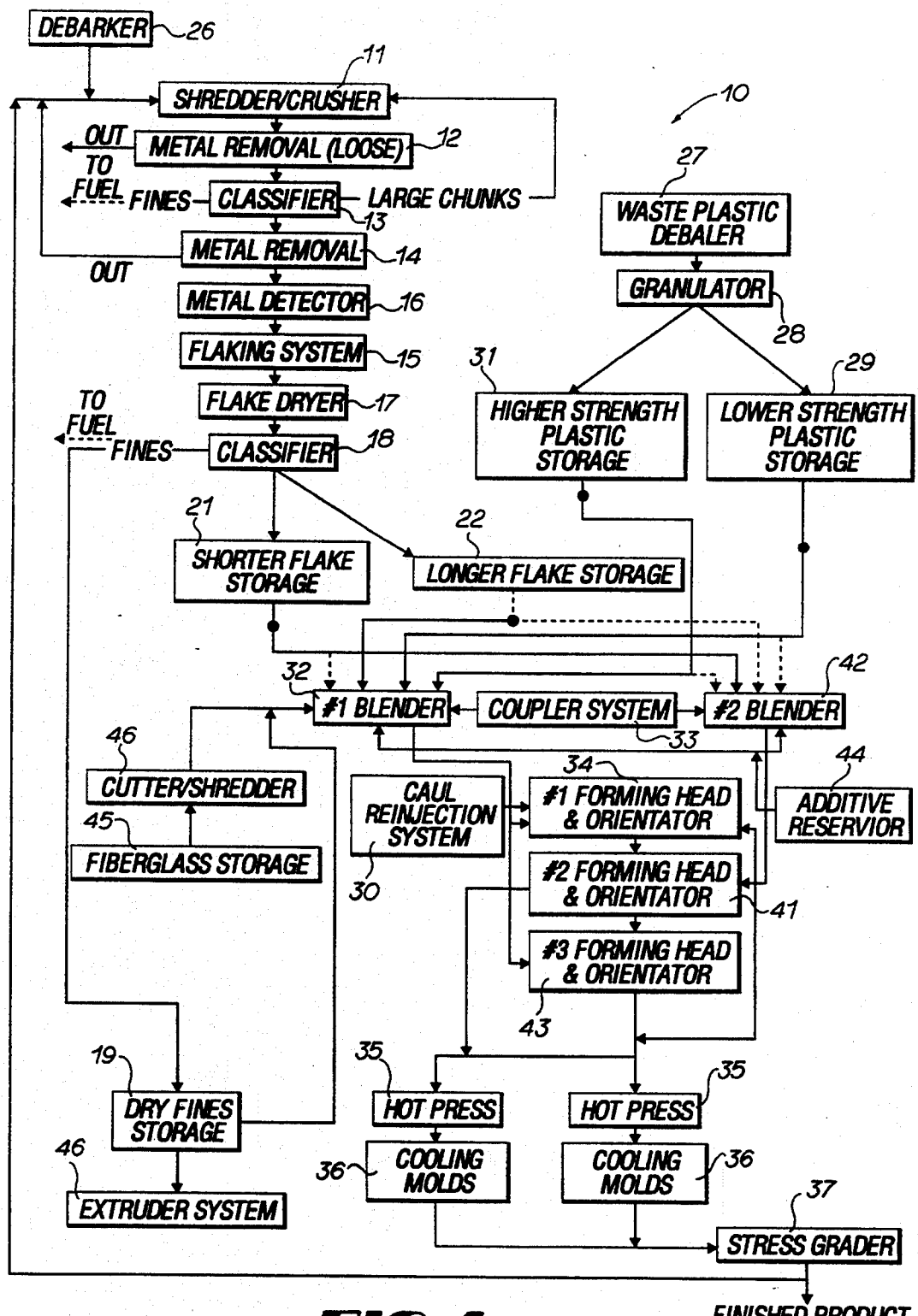
FIG. 1 is a diagrammatic representation of one embodiment of the process flow of the present invention.

Referring now in detail to the drawing figures, wherein like reference characters denote like parts throughout the several views, FIG. 1 shows a process flow 10 of one embodiment of the present invention. The raw material in feed components discussed herein generally is intended to be sourced from the waste stream, that is, waste wood, fiberglass and waste plastic. Waste woods utilized by the present invention generally fall into two classes: preprocessed wood waste such as wood pallets, waste wood products generated by construction projects, and any other waste wood fiber which previously has been processed, including dried and shaped. The second category of waste wood fiber is unprocessed or virgin fiber generated by timbering. This fiber includes tree tops not suitable for processing into other commercial wood products, non-commercial trees, damaged or diseased trees, and paper and lumber mill waste. Unlike prior processes, the method of the present invention is suitable for the utilization of soft woods and hard woods, singularly or mixed, whether such wood is green or previously dried. Waste wood which cannot be utilized includes wood treated with hazardous chemicals such as CCA or creosote. Examples of such waste wood include telephone poles, railroad ties and other building materials exposed to hazardous chemicals. Further, the present process does not use wood or cellulosic fiber from tree bark, leaves or grass to form its "primary products," although such fiber can be used to add density to "secondary products," as discussed herein.

The waste wood must be processed in a manner so as to be usable according to the present invention. The ultimate goal of the waste wood processing phase of the present invention is to comminute the waste wood to a desired length and thickness, and to classify the wood fibers so that they can be selectively utilized in the formation of an article having predetermined and desired physical properties. The mechanical equipment components discussed below which are incorporated into the process of the present invention are all known and commercially available equipment. Some examples are given, but various types of each piece of such equipment can be incorporated to alter or to modify process flow characteristics without changing the basic process of the present invention.

In the case of preprocessed waste wood, such as pallets, wood beam pieces and other wood scraps generated by building construction and wood generated by building demolition, the waste wood is fed into a shredder or crusher 11. The crusher reduces waste wood into smaller chunks, generally from 1 inch to 12 inches in length. Preprocessed waste wood such as waste building material normally will include metal. The crusher also necessarily separates a substantial portion of metal, such as nails and staples, from the initial waste wood fed into the system 10. The wood chunk and metal passed through the shredder is processed through a first magnetic metal separator 12. This metal separator removes any loose metal which is unattached to the wood chunks reduced in crusher 12. The loose metal is diverted out of the material process flow to a waste bin. The wood chunks then pass into a first classifier 13 which separates the smallest wood fibers, or fines, generally ⅛ inch or smaller, and the larger wood chunks, for example those pieces over 12 inches in length. Classifier 13 can be selectively adjusted either to remove particles over a certain size or to allow such particles to pass to the next stage of the system 10. For example, classifier 13 may be set to remove fines or wood fibers of a desired size from the system if those fines or fibers are not intended to be used either in the primary or a secondary product, as discussed below. In this case, the wood can be removed from the system and either used as fuel for the system dryer or diverted for other purposes. Similarly, classifier 13 can divert the longer wood chunks of virtually any length back through the shredder, or allow that length of wood chunk to pass further through the system.

Material passing through classifier 13 which is not diverted out of the main process flow then passes through a second metal remover 14. It is intended that the commercially available metal remover 14, such as a Sterns magnetic separator, be sufficient to detect and divert any remaining wood chunks having metal embedded therein back through the shredder 11. Commercially available metal remover systems can detect wood chunks embedded with metal, for example as small as a single staple, and remove those wood chunks from the system. The wood flaker 15 which receives wood from the classifier 13 is very sensitive to metal, that is, the blades of the flaker are readily damaged by contact with metal. Further, even if metal could pass through the flaker and into the finished article without damage to the flaker, typically it is not contemplated that metal pieces would be advantageous to the finished, molded article. A metal detector 16, such as a Sterns model 106X27 is placed in the system 10 between metal remover 14 and flaker 15. If any metal does pass through metal remover 14 without being diverted out of the system or back to shredder 11, metal detector 16 will initiate power interruption to the entire process flow, that is, to all equipment discussed herein.

Metal free wood chunks then are channeled into a wood flaker or flaking system 15. Flaker 15 is particularly important to the process of the present invention, since the present invention relies upon the controlled parameters of wood fiber thickness and length in order to form articles having certain preselected strength and other desired physical and mechanical characteristics. Flakers also are well known and commercially available. Suitable flakers are, for example CAE model 34–114 and those produced by Pallmann and Mier. The flaker can be selectively set to reduce the wood chunks into flakes of a predetermined thickness. The wood flakes produced by flaker 15 resemble thin wood chips or shavings of various lengths. It is intended to produce flakes of various lengths which are substantially uniform in thickness within a predetermined range. For example, in manufacturing an article such as a molded pallet, it has been found most desirable to utilize wood flakes within the range of 0.010 inch to 0.020 inch in thickness, with 0.015 inch in thickness being optimum. The flake preferred is approximately 0.015 inch or less. Suitable pallets have been manufactured using fiber thicknesses of up to 0.050 inch, which is considered an upper limit of flake thickness. Uniformity within a specified range of flake thickness is especially important in producing an article such as a pallet which is designed to carry a load, in order to avoid the presence of high pressure and low pressure areas, as discussed below.

Regarding the type of wood used, generally better results are achieved when several types or wood species are combined, rather than when a single wood species is used. Further, the shredder should be set so as to cut or break the wood chunks. Undesirable results may occur if the wood is crushed rather than cut or broken. The optimum thickness to length ratio of wood flakes averaging approximately 0.015 inch in thickness is approximately 300 to 1. This corresponds to a wood flake which is approximately 4½ inches in length. Additionally, the optimum thickness to length ratio for wood flakes averaging 0.038 inch in thickness is approximately 100 to 1. This results in a wood flake which is approximately 3⅞ inches in length. Further, it has been found that the present invention achieves better overall results when the flake thickness distribution throughout the article manufactured according to the present invention falls within a range of approximately plus or minus 0.005 inch for approximately 80% of the flakes used in the article. It also has been found that undesirable strength characteristics occur in articles comprised of flakes which are too thick, or are larger than the approximate ranges specified above, especially on "primary products" intended to withstand load stresses, such as material handling pallets.

The wood flakes then pass into flake dryer 17 which reduces the wood moisture content to between 0 and 5% moisture by weight. Also as discussed hereinafter, it is critical to the process of the present invention to control the wood fiber moisture content to within a specified range. A 5% moisture content by weight is considered the upper limit, with the desired range intended to be as close to zero moisture as possible. It is recognized, however, that soft wood in a humid storage environment will absorb moisture from the atmosphere, so that even softer wood dried so as to eliminate substantially all moisture probably will absorb 1 to 1.5% moisture by weight from the atmosphere. Wood flakes having a moisture content within the 1 to 1.5% range can be readily used within the present process, as can flakes having a moisture content of approximately 5% or less.

From the dryer 17, wood flakes pass into classifier 18 which classifies and separates the wood flakes according to length. At this point in the system 10, the wood flakes exiting dryer 17 are substantially within the preset range of thickness usable for a primary product, except for the fines in some applications. This embodiment of the present invention contemplates classifier 18 separating the wood flakes into three groups, although the classifier can be set to separate the flakes into a greater or lesser number of groups depending upon the characteristics of the desired, final product. In this embodiment, classifier 18 diverts the dried fines, that is, wood fibers approximately less than 3/16 inch in length, to a dried fines storage bin 19. These fines primarily are used in a secondary product. Classifier 18 also separates the wood flakes into two additional length ranges. The short flake length of the present embodiment includes flakes approximately 3/16 inch in length to approximately 3 inches in length. Flakes within this length range are diverted into short flake storage bin 21. Flakes over 3 inches in length, ideally up to approximately 8 inches in length, are separated by classifier 18 and diverted to long flake storage bin 22. Preprocessed waste wood flakes within storage bins 19, 21 and 22 are now in condition to be blended or combined with other materials in the formation of the finished article.

If virgin or previously unprocessed wood fiber such as tree tops, non-commercial trees, and limbs are used, a slightly different process is employed in order to produce the desired flakes. Since tree bark is not a desired component utilized by the process of the present invention, such virgin wood must be debarked in debarker 26. The usable wood then is diverted into shredder 11 and passed through the system as described above. Normally, such virgin wood does not contain metal; this wood raw material readily passes through the metal removal systems 12 and 14. Non-processed virgin wood fiber, however, normally has a higher moisture content than that of preprocessed waste wood. The flake dryer parameters normally must be changed to dry the virgin wood fiber to the desired moisture range of 0 to 5% by weight. These adjustments to the process flow certainly are within the knowledge of those skilled in the art, but the necessity of modifying the process somewhat when using different wood raw materials should be noted.

The second major structural component employed in the method and article of the present invention is plastic. Although virgin or unprocessed plastic certainly can be used, the application of the present invention ideally is suited for using waste plastic. Literally any type of waste plastic which is not contaminated by hazardous chemicals can be used. The present invention contemplates classifying the plastic utilized therein into two general categories, that is, higher strength plastics and lower strength plastics. The process, however, readily could be refined so as to classify the plastics according to specific type, molecular weight, or other physical, structural or mechanical properties. This may be desirable if it is intended that the finished product utilizes only one type of plastic. It has been found, however, that in manufacturing most articles, such as molded pallets, different types of plastic within the higher strength and lower strength classification can be blended and used. High strength plastics are considered to include high density polyethylene (HDPE), polyvinyl chloride (PVC), polypropylene (PPE) and other plastics of higher molecular weight. Lower strength plastics are considered low density polyethylene (LDPE), stretch-wrap type plastics, polystyrene and other lower molecular weight plastics.

The present invention contemplates comminuting the plastic to a size of approximately ⅛ inch by ⅛ inch, whether the plastic is a higher strength plastic or a lower strength plastic. Comminuting the plastic down to this particle size aids in plastic dispersion and migration during the molding phase or the forming of the finished article. Lower strength waste plastics such as LDPE and film-type plastics typically are provided by waste plastic processors in baled form. Plastic baled in this manner is fed into a debaler 27 where the plastic is debaled and separated, and then fed into a granulator 28 which reduces the plastic to the size of approximately ⅛ inch×⅛ inch. This plastic is then diverted into a lower strength plastic storage bin 29. The higher strength plastic such as HDPE is fed directly into the granulator 28 where it also is reduced to the size of approximately ⅛ inch×⅛ inch. The comminuted plastics which have been reduced in size as discussed above, whether higher strength plastic or lower strength plastic, are referred to as granules herein. It is important, however, that the plastic be substantially reduced in size, ideally to the ⅛ inch×⅛ inch sized granule. The higher strength plastic granule processed by granulator 28 is diverted into higher strength plastic storage bin 31 for storage. If desired, wood flakes of various lengths, thicknesses and/or widths can be combined in any one storage bin. Likewise, plastics of various types and strengths could be directed into any single plastic storage bin. At this point in the process, the major structural components of the finished article, cellulosic fibers, such as from wood flakes, and plastic, have been processed to their desired state for blending.

The present invention incorporates known molding and extrusion equipment and processes in the formation of the finished article. For example, if it is desired to manufacture a molded pallet comprised of a single layer or mat of reinforced composite material, a predetermined quantity of cellulosic fiber of a desired length and type, and a predetermined quantity of plastic of a desired strength are mixed to form a composite mixture. As is discussed in further detail below, there exist many variables which can be added, deleted, or modified which influence the physical properties of the finished product. Examples of such combinations are provided, however, products or finished articles which are intended to have a load bearing capability and must be stronger generally utilize longer wood fibers and higher strength plastics and/or fiberglass. Examples of such products include molded pallets used in material support and handling. Conversely, products which need only maintain a shape, without the necessity of having substantial strength would include mostly shorter fibers or flakes, or even wood fines, and lower strength plastic. An example of such a product would be a molded interior panel for an automobile.

An illustration of the implementation of the remaining process in the manufacture of an article is the production of a pallet having deep drawn portions, such as legs, from a single layer or mat of reinforced composite material. Considering that the pallet is intended to support weight, longer wood flakes and higher strength plastics are chosen as the primary structural material. First, the quantity of composite material is calculated depending upon the size, shape, and thickness of the intended finished product. For example, if 60% of the final volume is intended to constitute wood flakes, this volume is diverted from longer flake storage bin 22 to a first blender 32. The second major structural component of the product, HDPE, is delivered from plastic storage bin 31 into blender 32 to constitute 37% of the total blender volume, where the wood flakes and plastic are uniformly mixed. Each storage bin has a conventional weight and metering system for delivery of a predetermined amount of structural component from the storage bins to the blender. The weight and metering systems are computer controlled and integrated into the overall process control system. The blenders discussed herein preferably are drum-type blenders, conventionally known. Since a primary characteristic of the finished article is intended to be strength, a coupling agent or coupler is added from coupler storage bin 33 into blender 32. The coupler constitutes 3% of the total volume of the final mixture. Couplers preferably are waxes having low melting temperatures, which assist in plastic dispersion, plastic migration, penetration and flow, achieve better interface and compatibility between different types of plastic and between plastics, wood and fiberglass, aid in releasing the final product from the mold, and improve adhesion or the penetration into the wood fibers by the plastic. The addition of couplers, therefore, is found to increase the strength of the finished product. Coupler performances on waste wood generally is the same as on virgin wood. The amount of coupler utilized, however, can be lower for virgin wood flakes because of their more consistent length and width distribution after being processed by flaker 15.

The couplers are critical for even distribution of plastic on individual wood flakes, fiberglass reinforcement strands or other composite components. A preferred device used to apply coupler to wood and fiberglass is a Nordson Model 6120/H204 system which applies wax based couplers in small, ⅛ inch to 3/16 inch diameter "droplets." This system melts the coupler, and through a computerized controller, applies the coupler droplets at prescribed rates to fibers within the blenders 32 or 42. While each droplet is semi-liquid and in the process of solidifying, it attaches to the small plastic particles. Once it hardens, the plastic is firmly attached to the flake or strand. This is an important feature of couplers used, because the fiber and plastic attached are further processed and handled, and the plastic or coupler cannot come off the fibers. If the coupler does not stay adhered, it could cause an uneven plastic distribution within the mat.

An alternative method of applying the plastics and coupler to the wood fibers is to use a single screw extruder, commonly known in the art, which melts both the plastics and coupler and applies the required pressure to apply small droplets of liquid plastic/coupler directly on to the wood fibers.

The following examples are of test results of HDPE and LDPE plastics and the various couplers and waxes, and then tested in tension:

| | MAXIMUM POUNDS AT FAILURE | |
|---|---|---|
| COUPLER USED | LDPE | HDPE |
| Base Plastic Only (No coupler) | 320 | 454 |
| Homopolymer | 598 | 568 |
| Paraffin Wax | 408 | 520 |
| Etylene Maleic Anhydride Copolymer | 795 | 670 |
| Modified Polymer of Propylene | 596 | 574 |
| Graft Polymer of Polyethylene & Anhydride | 464 | 643 |

The above test results compare with, for example, a thermoset PF system which has a 530 pound average. The coupler application rate depends on product strength requirements, whether the product is deeply molded or flat, the amount of plastic required in the mat and the densities of the plastics being used. As a general rule, the amount of coupler used will range from 1% to a maximum of 4% by weight of the total mat. Film type waste plastic, that is, LDPE and LLDPE, require slightly more coupler than HDPE particles.

Each plastic and coupler used has its own processing variables, that is, the point at which they melt and are able to flow out or migrate. This point is coupled to the amount of pressure required to make these constituents migrate within the mat. If the pressure is applied before the plastic is liquified, it causes the plastic to be very localized and not flow out, penetrate and cover the flakes. It also reduces the heat transfer, because the plastic is the major source of heat penetration or transfer within the mat. If the heat transfer is too high, it can cause some plastics to cross-link, which may reduce product strength.

A predetermined quantity of the cellulosic fiber/plastic/coupler mixture, or reinforced composite mixture sufficient to manufacture one finished article is delivered from blender 32 onto mat forming head 34. Mat forming head 34 can be of a type commonly used in the molded composite industry well known to those skilled in the art and as referred to in U.S. Pat. No. 5,142,994 to Sandberg et al. A preferred, conventional forming head allows the wood flakes to be aligned in a particular direction. The forming heads can make endless mats which can be cut to various lengths prior to pressing. Otherwise, in the case of deeply molded products, a metal caul system is utilized. In the present invention, an aluminum caul (not shown) is directed beneath forming head 34 from a conventional caul reinjection system 30. Forming head 34 delivers a predetermined quantity of reinforced composite mixture onto the metal caul from caul reinjection system 30 to form a mat of composite mixture on the caul. The mat is deposited on the caul uniformly in thickness, even into the deeper drawn portions of the mold or caul, which deeper portions constitute deep drawn legs of the pallet in the present example. The forming head also includes equipment (not shown) to tamp the mixture down into the deep drawn portions such as the legs of the mold, such equipment is sometimes referred to as densifiers. The caul and the mat of composite material are then delivered to a die or press 35, such as that manufactured by Globe Manufacturing Company, model 18Z Pre-Press. Sufficient pressure and temperature are applied to the mat in order to cause the mat to substantially assume the form of the mold or caul. The pressure and temperature applied by the die is somewhat dependent upon the type and blend of composite mixture used and the quantity of mixture forming the mat. Those skilled in the art readily understand the parameters of temperature and pressure which are individually applied on these materials. For example, the present system has been operated successfully using dyes or molds having heated surface temperatures of approximately 390° F. to 400° F. and pressure of 450 psi and less. At the above temperatures, the finished articles have been successfully manufactured at pressures of approximately 200 psi. Generally, wood fibers that are approximately ½ inch or less in length and wood fines require higher pressures in order to achieve high strength and physical properties. Wood flake compression in the final product depends upon the type of product being manufactured, and its required strengths. Generally, for most products, a flake compression rate of 5% to 15% is sufficient to get the optimum heat transfer, plastic migration and flake penetration and coating in presses 35. Further, each plastic has a very specific operating temperature range where the plastics are most effectively formed. If the temperature is too low, the plastic will not melt and flow or penetrate the wood fibers. If the temperature is too high, the plastics may cross-link or begin to degrade. The primary function of the pressurized forming heads or presses 35 are to consolidate the mat and to remelt the plastic to cause plastic migration, flow and heat transfer of the ingredients within the mat. The normal heat and pressure ranges processing for LDPE on HDPE are 350° F. to 400° F. and 50 psi to 250 psi.

While the cooling process also can occur in the hot press, it is more efficient to cool outside the hot press. In this process, at the end of the hot pressing cycle, the press 35 opens up the aluminum caul that the mat is built upon, and the product is lifted out of the mold. Mold release chemicals can be used to keep the molds from sticking to the hot plastic surfaces of the mat. The product or mat can be conveyed to a cooling mold 36 outside the hot press 35. Cooling mold pressures required are less than approximately 50 psi. This process eliminates the need for constant heating and cooling of the same mold. Cooling cycle time generally is less than the heating and compression cycle.

The cooling process is critical, in that it sets the plastic's memory to the desired shapes, sizes and desired tensions. Plastics generally have a higher thermal expansion rate than most other materials. Contraction rates for LDPE and HDPE averages 3.1% based on cubic volumes. Both expansion and contraction features are taken into account within the composite technology. On the expansion side, this aids the press pressure being applied. As the plastic is remelted, it expands, which promotes migration, coverage, heat transfer and filling in of low pressure areas. As the composite cools, it contracts, which densifies the mat or product and sets the plastic memory to the fixed shape and size desired. This contraction feature enhances product performances in that, as plastic cools, it is drawn up in and around the wood fibers, which serves to pre-tension them. When an external load is applied to the product, it more evenly distributes any externally applied loads. One of plastics' key features is its memory. Once set, then stressed, it generally tends to return to its original form or shape. Depending upon the type of press system utilized from conventional systems, the formed mat either is allowed to cool in the press or is transferred to cooling molds 36.

The formed article is then separated from the metal caul in a conventional manner and the caul is returned to the caul reinjection system 35 for reinjection into the process flow as discussed above. The finished article is then delivered to stress grader 37 for quality control analysis. Stress grader 37 can be of any known optical and/or ultrasound stress graders. If the finished article passes quality control analysis, it is removed from the process system. If the article is rejected for some reason, as being flawed, it is returned to shredder 11 for reprocessing through the system for use especially in secondary products.

The above-described process is referred to herein as a "primary process" resulting in a finished article which is considered a primary article or product of the present invention. Another example of the formation of a primary article is a finished article formed of multilayers of mats, each mat having predetermined physical characteristics contributing to the overall physical properties of the finished product. For example, a multilayer product such as a pallet can be manufactured having three layers, a first or tension layer, a second or core layer, and a third or compression layer. In engineering such a product, it is found desirable to include the higher strength composite mixture combination under the general parameters discussed above in the tension and compression layers, and a lower strength combination, adding density to the finished article, in the second or core layer. In the manufacture of such a product, longer flakes of, for example 3 inches to 8 inches and higher, strength plastic such as HDPE and coupler are delivered to blender 32 in the ratios of 60% wood flakes or cellulosic fibers, 37% HDPE and 3% coupler, by volume. This reinforced composite mixture is blended in blender 32, and a quantity of the blended mixture is delivered to forming head 34. A metal caul is delivered from caul reinjection system 35 to forming head 34, where a first layer or first mat of reinforced composite mixture is deposited uniformly onto said caul by forming head 34 with substantially all the wood fibers aligned in a predetermined direction, and the mat is densified. In this example it is intended that the first mat will constitute 25% of the total volume of the finished article. The same caul carrying the first mat is then directed to a second mat forming head 41 which uniformly deposits a second layer or mat of composite material on top of the first layer. In this example, it is intended that the second or core layer of composite material will constitute 50% of the total volume of material in the finished product and will be comprised of shorter cellulosic fibers, from 3/16 inch to 3 inches and lower strength plastic such as LDPE which has been blended in a second blender 42 and delivered to mat forming head 41. The orientation of the cellulosic fibers in the second layer is directed transversely to the orientation of the fibers laid down in the first layer, by a flake aligner associated with mat forming head 41. The same caul is then directed to mat forming head 43 which deposits a third mat of reinforced composite product onto the second mat. The third or top mat is comprised of the stronger reinforced composite mixture delivered from the first blender 32 to mat forming head 43 identically as discussed above in this example with respect to the first or bottom layer deposited by mat forming head 43. The cellulosic fibers deposited by mat forming head 43 are aligned in the same direction as the fibers of the first or bottom mat, and transversely to the orientation or alignment of the fibers deposited by forming head 41. Therefore, the first or bottom mat and the third or top mat are substantially identical in composition and flake alignment. Additionally, as discussed above, each mat forming head includes a densifier which pushes or compacts the cellulosic fibers down into the deeper drawn portions of the caul after each mat is deposited. This ensures that the fibers are somewhat compacted or tamped into the deeper drawn portion after each mat is deposited, and prior to the caul and its associated mixture being heated and pressurized.

Lower strength products can utilize shorter length flake distribution in single layers, with random flake orientation. Molded areas and deep draws and shapes in the finished product that require higher strengths, utilize longer flake distribution and layered mats with the wood fibers aligned in different directions, to meet strength requirements. A molded pallet, for example, can utilize 3 inch to 8 inch flakes on the surface layers, with only 3 inch and longer flakes aligned in machine direction, and with surface layers comprising 20% to 30% of total mat. The core layer for example can utilize approximately 3/16 inch to 3 inch flakes, with 3 inch and longer transversely aligned or in the cross machine direction. Variables such as flake length and percentage of component distribution, as well as total volume, couplers and the type of plastic used in each layer, are adjustable depending upon the desired product characteristics.

The same metal caul is then delivered from mat forming head 43 to press 35 where temperature and pressure is applied. As discussed above with respect to the first example, the temperature and pressure causes the plastic to remelt and to migrate throughout the mat filling all interstices between and within the cellulosic fibers. The article is then allowed to cool within press 35, or is transferred to cooling press 36 where the memory of the plastic is set, resulting in the finished article. The article is graded and either accepted or is rejected and returned to the system as described above.

It is intended that the entire system or process be integrated and computer-controlled. The control of such system of known equipment is readily integrated into such a computer control system. It has been previously mentioned that the entire system can be stopped if metal is detected at the input of the flaker. Similarly, this continuous system is considered ideal for such integrated controls. If an error or problem is associated with any single piece of equipment, such problem is automatically detected by sensors within the control system and the remaining system is stopped or modified until the problem is remedied.

In a multiforming head and multiblender process according to the present invention, any number of mats or layers having selected physical characteristics can be included into the finished article, within the tolerances of the equipment being utilized. Optionally, other physical characteristics can be incorporated into the article by adding chemicals having the desired properties to blenders 32 or 42. For example, if it is intended that the finished article exhibit stronger antimicrobial characteristics, an antimicrobial agent contained in additive reservoir or tank 44 could be injected into blender 32 and/or blender 42 for inclusion into the reinforced composite mixture. Other additives which might be used are contemplated to include pesticides or dyes, although any number of additive chemicals is possible as long as the chemicals do not interact adversely or include a moisture content which would cause the reinforced composite mixture to exhibit a total moisture content over a maximum of 5% moisture by weight. As is well known in the art, mixtures including moisture contents which exceed a safe level can result in accidents such as explosions during the pressing operation or at a minimum can result in delamination or other undesired characteristics in the finished product. It is essential, therefore, that any modification to the process by inclusion of different chemicals or additives within the reinforced composite mixture take into account the need to restrict moisture content.

Another option exists in which fiberglass, such as fiberglass rovings, can be added, especially to impart higher strength characteristics and improvements in tension and stiffness to the finished article. In the three layered pallet example given above, it is contemplated that waste or virgin fiberglass from bin 45, which fiberglass has been comminuted in shredder 46, is added to the mixture contained in blender 32 in order to add fiberglass rovings to both the first or bottom and to the third or top layers. This addition of fiberglass has been found to greatly increase the strength of the finished article. Fiberglass, however, also can be randomly mixed throughout a mat layer in the core layer or in several mat layers. It is even possible to form a finished article consisting entirely of a combination of fiberglass and plastic. It is only necessary that the raw material components be blended in desired ratios and formed according to the methods described above. This provides an additional option of diverting used fiberglass from the typical waste stream such as landfilling, and reusing the fiberglass in yet another recycled product.

Two types of waste fiberglass are utilized for very high strength applications, especially for improved tension and stiffness (modulus of elasticity). Fiberglass roving reinforcement strands which are cut to 3 inches to 8 inches can be used. This material has continuous fiberglass filament within each strand. Also, fiberglass in the form of a mat material can be used. This mat material is made similar to paper, and has random fibers. The mat is cut into 2 inch×2 inch pieces. The fiberglass fibers can be mixed randomly throughout the mat or can be selectively used, that is, in the tension or compression layers or also on the mat surfaces. Roving type fiberglass fibers can be aligned if required for directional strength improvements similarly as discussed above with respect to aligning wood fibers. The normal application for fiberglass, however, is limited to products that require high strengths.

Products made of only waste fiberglass and waste plastics also can be manufactured on the same process system. Several other types of waste fiberglass have been successfully used, besides the rovings and mats, such as edge trim from mat glass. All waste fiberglass utilized, must be refined down into small chunks or fibers, with approximately ½ inch×½ inc fiber chunks being the smallest useable size. The former system will handle this size without having to modify the former system. Smaller fiberglass sizes can be used, but a different former system usually is required, such as those well known and used in particleboard manufacturing.

While "primary" products or products which include specifically engineered physical characteristics and qualities are made using the above process, "secondary" products also can be made using the lesser quality raw materials, or reusing the rejected products made using the primary process. A secondary product is considered a product which must take a certain form, but which is not required to exhibit the stringent physical characteristics as a primary product such as, in the case of a pallet, the ability to be molded in deep drawn shapes and to withstand specific high stress. An example of a secondary product using this process could be a 4 inch×4 inch landscape timber for use in situations in which critical strength characteristics are not required. In the manufacture of the secondary products, the wood fines separated by classifier 18 which are stored in fines storage bin 19 are either introduced into blender 32 for blending with plastic and forming as discussed above or are directed to a conventional extruder system 46. Wood fines provide mostly lighter density to such a finished secondary product and do not impart the same strength characteristics which are imparted by long wood fibers since the desired longer wood fiber matrix is not present. The major variables that affect product densities are the type and amount of plastics and fiberglass utilized, and the contraction rate of plastics when cooled. Product densities are not so dependent on how much the wood fibers are being compressed. Product internal bond or adhesion is more contingent upon good plastic dispersion, migration and penetration into the wood fibers through the compression of the wood fibers.

Additionally, finished articles made by the primary process which are rejected as being flawed can be reintroduced into the system at shredder 11 where they are finely comminuted, directed entirely to dry storage bin 19 and then later used in a secondary product. In this manner, essentially all of the materials used in the above process either can be incorporated into the primary product or can be reused and incorporated into a secondary product. Primary products or finished articles can be returned to the system and similarly formed into secondary products after their useful life as primary products has expired.

The above discussed procedure sets forth the basic steps of the process of the present invention. Many variables, however, which are used by the process can be added, modified or eliminated in the engineering of a specific finished article. For example, these variables include length of cellulosic or wood fiber, the quantity of fiber incorporated into the reinforced composite mixture by volume, the addition of a wax or coupler in various quantities, the type of coupler used, the types or combinations of plastic used, the ratio of cellulosic fibers to plastic within the mixture, the addition of fiberglass, the use of more than one layer in the finished article, the use of fiberglass along with the above components, and the use of chemical additives. While it is known and disclosed that the use of materials such as longer fibers, high molecular weight or high density plastics, couplers, fiberglass and multilayers, add higher strength to a product, and that shorter cellulosic fibers or fines and lower strength plastics add density and form rather than higher strength, any number of combinations of these variables is possible to result in a finished product having slightly different physical characteristics. For example, the following tables specify the mechanical properties exhibited by the components used in manufacturing reinforced composite products:

| | | |
|---|---|---|
| I. | Plastic Tensile Strengths at Break (PSI) | |
| | Low density polyethylene (LDPE) | 1200 to 4000 |
| | High density polyethylene (HDPE) | 3200 to 4500 |
| | Polypropylene | 4500 to 6000 |
| | Polyester, thermoplastic | 7000 to 10,500 |
| | Polyvinyl chloride | 1500 to 7500 |

| II. | Woods (MORs and MOE - Dry Basis) | | |
|---|---|---|---|
| | | MORs (PSI) | MOEs (millions/PSI) |
| | Beech | 14,900 | 1.72 |
| | Birch | 12,300 | 1.59 |
| | Hickory | 17,100 | 1.79 |
| | Maple | 13,400 | 1.64 |
| | Oak - Red | 10,900 | 1.49 |
| | Oak - White | 18,400 | 1.98 |
| | Sweetgum | 12,500 | 1.64 |
| | Yellow Poplar | 10,100 | 1.58 |
| | Douglas Fir | 11,900 | 1.49 |
| | Fir - White | 9,800 | 1.50 |
| | Pine - Loblolly | 12,800 | 1.79 |
| | Spruce | 9,300 | 1.30 |

| | |
|---|---|
| III. | Fiber Glass Reinforcements, Mats and Others |
| | Single filament tensile average = 205,000 to 298,000 |
| | Single filament youngs Modulus average = 1,200,000 to 1,350,000 |

Pallets were manufactured according to the above process and tested for strength. The following are exemplary of the relative strengths of the pallets made with different compositions of materials using the process of the present invention:

EXAMPLE A
EXAMPLE OF BLEND RATIOS AND ACTUAL STRENGTH VALUES FOR DIFFERENT FIBERS & COMPONENTS
(Based on % by Weight)

| TYPE WOOD FIBER | TYPE MAT | % WOOD | % & TYPE PLASTIC | % COUPLER | % FIBERGLASS |
|---|---|---|---|---|---|
| Fine, (hard and soft woods) | SINGLE | 70% | 30%-LDPE | 0 | 0 |
| ($\frac{1}{8} \times \frac{1}{8}$ & less) | " | 70% | 27%-PP | 3% | 0 |
| | " | 70% | 30%-LD & HDPE | 0 | 0 |
| | SINGLE | 60% | 30%-LD & HDPE | 0 | 10% |
| | " | 60% | 30%-LD & HDPE | 0 | 10% |
| | " | 60% | 30%-LD & HDPE | 0 | 10% |
| Shorts (hard and soft woods) | SINGLE | 70% | 30%-LDPE | 0 | 0 |
| ( l @ $\frac{1}{8}$" to 1") | " | 70% | 27%-PP | 3% | 0 |
| (w @ .010 to $\frac{1}{8}$") | " | 70% | 30%-LD & HDPE | 0 | 0 |
| (t @ .010 to $\frac{1}{8}$") | SINGLE | 60% | 30%-LD & HDPE | 0 | 10% |
| | " | 60% | 30%-LD & HDPE | 0 | 10% |
| | " | 60% | 30%-LD & HDPE | 0 | 10% |
| Intermediate Flakes | SINGLE | 65% | 35%-LDPE | 0 | 0 |
| (hard and soft woods) | " | 65% | 32%-PP | 3% | 0 |
| (l @ $\frac{1}{8}$" to 3") | " | 65% | 35%-LD & HD | 0 | 0 |
| (w @ .010 to $1\frac{1}{2}$") | SINGLE | 55% | 21%-HD & LD | 0 | 24% |
| (t @ .015 to .025) | " | 55% | 21%-HD & LD | 0 | 24% |
| | " | 55% | 21%-HD & LD | 0 | 24% |
| Long Flakes | LAYERED | 60% | 40%-LD | 0 | 0 |
| (hard and soft woods) | " | 60% | 37%-PP | 3% | 0 |
| (l @ 3/16" to 8") | " | 60% | 40%-LD & HD | 0 | 0 |
| (w @ .010 to 3") | LAYERED | 56% | 31%-LD & HD | 3% | 10% |
| (t @ .038 to +/− .010) | " | 56% | 31%-LD & HD | 3% | 10% |

| TYPE WOOD FIBER | TYPE MAT | FIBERGLASS LOCATION SURFACE | FIBERGLASS LOCATION RANDOM | PCF DENSITY | MOR |
|---|---|---|---|---|---|
| Fine, (hard and soft woods) | SINGLE | 0 | 0 | 50 | 2275 |
| ($\frac{1}{8} \times \frac{1}{8}$ & less) | " | 0 | 0 | 50 | 3420 |
| | " | 0 | 0 | 50 | 4249 |
| | SINGLE | X | 0 | 50 | 9119 |
| | " | X | 0 | 60 | 9379 |
| | " | X | 0 | 70 | 9639 |
| Shorts (hard and soft woods) | SINGLE | 0 | 0 | 50 | 1407 |
| (l @ $\frac{1}{8}$" to 1") | " | 0 | 0 | 50 | 2552 |
| (w @ .010 to $\frac{1}{8}$") | " | 0 | 0 | 50 | 3382 |
| (t @ .010 to $\frac{1}{8}$") | SINGLE | X | 0 | 50 | 8252 |
| | " | X | 0 | 60 | 8512 |
| | " | X | 0 | 70 | 8772 |
| Intermediate Flakes | SINGLE | 0 | 0 | 50 | 3739 |
| (hard and soft woods) | " | 0 | 0 | 50 | 4884 |
| (l @ $\frac{1}{8}$" to 3") | " | 0 | 0 | 50 | 5714 |
| (w @ .010 to $1\frac{1}{2}$") | SINGLE | X | X | 50 | 6639 |
| (t @ .015 to .025) | " | X | 0 | 50 | 10,584 |
| | " | X | 0 | 60 | 10,844 |
| Long Flakes | LAYERED | 0 | 0 | 50 | 4326 |
| (hard and soft woods) | " | 0 | 0 | 50 | 5471 |
| (l @ 3/16" to 8") | " | 0 | 0 | 50 | 6301 |
| (w @ .010 to 3") | LAYERED | X | 0 | 50 | 11,171 |
| (t @ .038 to +/− .010) | " | X | 0 | 60 | 11,431 |

EXAMPLE B
SPECIFIC EXAMPLES WITH VARIABLE BLEND RATIO, MAT COMPOSITION WITH PERFORMANCE PROPERTIES

| | Tensile (PSI) | Tensile MOE (PSI) | SHEAR MODULUS (PSI) | DENSITY (PCF) | COEFF. OF EXPAN (IN/IN/F) |
|---|---|---|---|---|---|
| I. HARDWOOD ONLY - "FINES"<br>BLEND RATIO: Wood at 70%, P.P. @ 30%<br>Single layer and random wood orientation | 1,796 | 67,370 | 39,528 | 66 | — |
| II. HARDWOOD & SOFTWOOD - "SHORTS"<br>BLEND RATIO: Wood @ 50%, P.P. @ 30%, Coupler 3%, Fiberglass @ 17%<br>Single layer and random wood orientation fiberglass on surfaces only | 5,806 | 117,800 | 40,511 | 60 | .00004 |
| III. HARDWOOD & SOFTWOOD - "LONG FLAKES"<br>BLEND RATIO: Wood @ 65%, P.P. @ 32%, Coupler 3%, Single layer and random wood orientation<br>Wood flake length distribution:<br>1" to 3" @ 90% | 3,351 | 57,760 | 32,827 | 63 | .00001 |

-continued

EXAMPLE B
SPECIFIC EXAMPLES WITH VARIABLE BLEND RATIO, MAT COMPOSITION WITH PERFORMANCE PROPERTIES

| | | | | | |
|---|---|---|---|---|---|
| 3/16" to 1" @ 10% | | | | | |
| IV. HARDWOOD & SOFTWOOD - "LONG FLAKES"<br>BLEND RATIO: Wood @ 57%, P.P. @ 30%,<br>Coupler 3%, Fiberglass @ 10%<br>Wood flake length @ 1" to 4"<br>3 layer mat & random orientation<br>Tension layer @ 12%<br>Core layer @ 76%<br>Tension layer @ 12%<br>Fiberglass on surfaces only | 4,954 | 154,200 | 41,881 | 65 | .00001 |
| V. HARDWOOD & SOFTWOOD - "LONG FLAKES"<br>Wood flake length distribution<br>+2" to 6" @ 35%<br>3/16" to 2" @ 65%<br>BLEND RATIO: Wood @ 60%, P.P. @ 37%<br>Coupler 3%<br>3 layer mat & random orientation<br>Tension layer, 3" to 6" flakes @ 23%<br>Core layer, 3/16" to 3" flakes @ 54%<br>Tension layer, 3" to 6" flakes @ 23% | 2,830 | 74,060 | 29,894 | 56 | .00006 |

| | COMPRESSION (PSI) | MOR (PSI) | MOE (PSI) | INTERLAMINAR TENSILE (PSI) |
|---|---|---|---|---|
| I. HARDWOOD ONLY - "FINES"<br>BLEND RATIO: Wood at 70%, P.P. @ 30%<br>Single layer and random wood orientation | 13,333 | 4,497 | — | — |
| II. HARDWOOD & SOFTWOOD - "SHORTS"<br>BLEND RATIO: Wood @ 50%, P.P. @ 30%,<br>Coupler 3%, Fiberglass @ 17%<br>Single layer and random wood orientation<br>fiberglass on surfaces only | 15,220 | 10,250 | 703,400 | 459 |
| III. HARDWOOD & SOFTWOOD - "LONG FLAKES"<br>BLEND RATIO: Wood @ 65%, P.P. @ 32%,<br>Coupler 3%, Single layer and random<br>wood orientation<br>Wood flake length distribution:<br>1" to 3" @ 90%<br>3/16" to 1" @ 10% | 14,500 | 5,916 | 571,000 | 423 |
| IV. HARDWOOD & SOFTWOOD - "LONG FLAKES"<br>BLEND RATIO: Wood @ 57%, P.P. @ 30%,<br>Coupler 3%, Fiberglass @ 10%<br>Wood flake length @ 1" to 4"<br>3 layer mat & random orientation<br>Tension layer @ 12%<br>Core layer @ 76%<br>Tension layer @ 12%<br>Fiberglass on surfaces only | 15,380 | 10,750 | 831,500 | 277 |
| V. HARDWOOD & SOFTWOOD - "LONG FLAKES"<br>Wood flake length distribution<br>+2" to 6" @ 35%<br>3/16" to 2" @ 65%<br>BLEND RATIO: Wood @ 60%, P.P. @ 37%<br>Coypler 3%<br>3 layer mat & random orientation<br>Tension layer, 3" 6" flakes @ 23%<br>Core layer, 3/16" to 3" flakes @ 54%<br>Tension layer, 3" 6" flakes @ 23% | 3,155 | 6,687 | 662,100 | 326 |

EXAMPLE C
SPECIFIC EXAMPLES OF LOW PRESSURE PRESSING, THICK AND THIN FLAKES, VARIABLE BLEND RATIOS, MAT COMPOSITION & PERFORMANCE PROPERTIES

| | PRESSURE (PSI) | DENSITY (PCF) | MOR (PSI) | MOE (PSI) |
|---|---|---|---|---|
| I. LONG THIN FLAKES (.014) HW 65%, SW @ 35%<br>BLEND = Wood @ 60%, HDPE @ 40%<br>3 layer mat.<br>Tension layer 4" to 6" flakes, aligned MD = 25%<br>Core layer 2" to 4" flakes, aligned CMD = 50%<br>Tension layer 4" to 6" flakes, aligned MD = 25% | 250 | 59 | 8,278 | 672,200 |
| II. LONG THIN FLAKES (.014) HW @ 65%, SW @ 35%<br>BLEND = Wood @ 52%, plastic @ 34% (LDPE @ 37% &<br>HDPE @ 63%) fiberglass @ 2" to 5" - 14%<br>3 layer mat.<br>Tension layer 4" to 6" flake, aligned MD, 2" to 5" fiberlass = 28%<br>Core layer 1" to 4" flakes, random orientation = 44% | 109 | 52 | 5,525 | 336,700 |

-continued

EXAMPLE C
SPECIFIC EXAMPLES OF LOW PRESSURE PRESSING, THICK AND THIN FLAKES, VARIABLE BLEND RATIOS, MAT COMPOSITION & PERFORMANCE PROPERTIES

| | PRESSURE (PSI) | DENSITY (PCF) | MOR (PSI) | MOE (PSI) |
|---|---|---|---|---|
| Tension layer 4" to 6" flakes, aligned MD, 2" to 5" fiberglass = 28% | | | | |
| III. LONG THIN FLAKES (.014) & LONG THICK FLAKES (.038) WITH POWDER PF THERMOSET ADHESIVE<br>HW @ 65%, SW @ 35%, BLEND = Wood @ 63%, HDPE @ 34%, Powder P/F @ 3%<br>3 layer mat.<br>Tension layer 4" to 6" flakes @ .038, HDPE, aligned MD = 32%<br>Core layer 3/16" to 2" flakes @ .014, powder P/F adhesive, random = 36%<br>Tension layer 4" to 6" flakes @ .038, HDPE, aligned MD = 32% | 200 | 47 | 6,636 | 336,700 |
| | | | Compressive Stress at Max Load (PSI) | Displacement at max load (IN) |
| IV. MOLDED ELLIPTICAL CONE SHAPE, 4" DEEP DRAW WITH 66 DEGREE SIDE WALLS ANGLE<br>Long thick flakes (.038) 3/16" to 8" BLEND = Wood @ 57%, HDPE @ 40%, coupler @ 3%, HW @ 65%, SW @ 35%<br>3 layer mat.<br>Tension layer 3/16" to 8" aligned 3" & longer MD = 33%<br>Core layer 3/16" to 8" aligned 3" & longer in CMD = 34%<br>Tension layer 3/16" to 8" aligned 3" & longer in MD = 33% | 167 | 49 | 9,291 | .4989 |

EXAMPLE D
SPECIFIC EXAMPLES OF LOW PRESSURE PRESSING, THICK AND THIN FLAKES, VARIABLE BLEND RATIOS, MAT COMPOSITION & PERFORMANCE PROPERTIES

| | PRESSURE (PSI) | DENSITY (PCF) | MOR (PSI) | MOE (PSI) |
|---|---|---|---|---|
| V. LONG THICK FLAKES (.038) AND THIN LONG FLAKES (.014)<br>Wood specie & flake length distribution:<br>Hardwood flakes, (.038) lengths 3/16" to 8" @ 73%<br>Softwood flakes, (.014) lengths 3/16" to 5" @ 27%<br>Both species, lengths & thickness mixed prior to blending & forming<br>BLEND RATIO: Wood @ 53%, HDPE @ 44%, coupler @ 3%<br>5 layer mat.<br>Surface layer of HDPE @ 11%<br>Tension layer of 3/16" to 8" flakes, 3" and longer aligned MD @ 19%<br>Core layer of 3/16" to 8" flakes, 3" and longer aligned CMD @ 40%<br>Tension layer of 3/16" to 8" flakes, 3" and longer aligned MD @ 19%<br>Surface layer of HDPE @ 11% | 169 | 50 | 16,270 | 1,096,000 |
| VI. SHORT WOOD FLAKES WITH 5% COMPRESSIGN RATE ON FLAKES<br>Hardwood flakes @ 73%, Softwood flakes @ 27%<br>BLEND Ratio: Wood @ 47%, plastic @ 50% (LDPE @ 70% & HDPE @ 30%), coupler @ 3% (new blend)<br>5 layer mat.<br>Surface layer of HDPE only @ 7%<br>Tension layer of only 3" .028 flakes aligned M/D, LDPE @ 18%<br>Core layer of ⅛" to 2" .014 flakes random alignment, LDPE @ 50%<br>Tension layer of only 3" .028 flakes aligned MD, LDPE @ 18%<br>Surface layer of HDPE only @ 7% | 101 | 51 | 5,924 | 376,500 |

Figure 2:
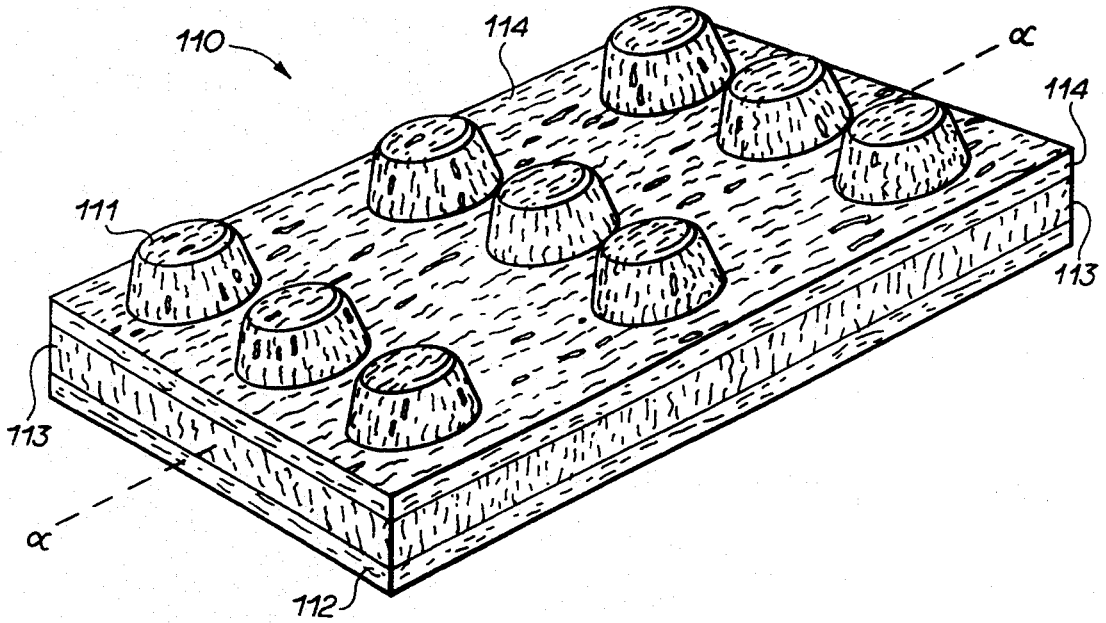
FIG. 2 is a perspective view of a finished article formed according to one method of the present invention.

Abbreviation Key
HW = Hardwood Species
SW = Softwood Species
MD = Machine Direction
CMD = Cross Machine Direction
LDPE = Low Density Polyethylene
HDPE = High Density Polyethylene
Powder PF = Phenol-Formaldehyde
PP = Polypropylene FIG. 2 depicts a molded article produced using the three layered process described above. The article shown in this illustration is a pallet, depicted inverted, used in material handling, although it is not intended that the present invention be limited to such an article. Virtually any article capable of being molded as described above can be formed using the process of the present invention. Such articles include automobile interior panels, decorative trim or molding such as inverted and raised moldings, cabinet doors and door inserts, caskets, doors, and compression moldings. Pallet 110 is a primary finished article, and includes deep drawn portions or pallet legs 111 which extend outwardly and are formed as discussed above. Pallet 110 preferably is a multilayered pallet having a first or tension layer 112, a second or core layer 113, and a third or compression layer 114. Preferably, slightly more plastic can be applied to the bottom surface layer 114 of pallet 110 as specified above. This addition of plastic to the bottom surface layer 114 causes the pallet to be slightly crowned when unloaded, that is, the center legs are slightly off of the ground or support surface when pallet 110 does not support a load. This phenomenon is accomplished due to the plastic drawing up as it cools. Therefore, it is possible to pre-stress the plastic to reduce pallet deflection when supporting a load. Another way to reduce pallet deflection is to use only the higher strength HDPE in the tension layer 112 and to use longer wood flakes aligned with the longer pallet direction. This provides for the better transferring of stress on the tension side throughout the mat matrix and avoids stresses in localized areas. Pallets formed using the above process are found to have a load capacity of 2800 pounds dynamic and 30,000 pounds static. The pallet weight normally is between 28 and 35 pounds and having a density of 40 to 55 pounds per cubic foot. The deck thicknesses range from ⅜ to ½ inch, with leg side wall thicknesses approximately 95% to 125% of the deck thickness.

Figure 3:
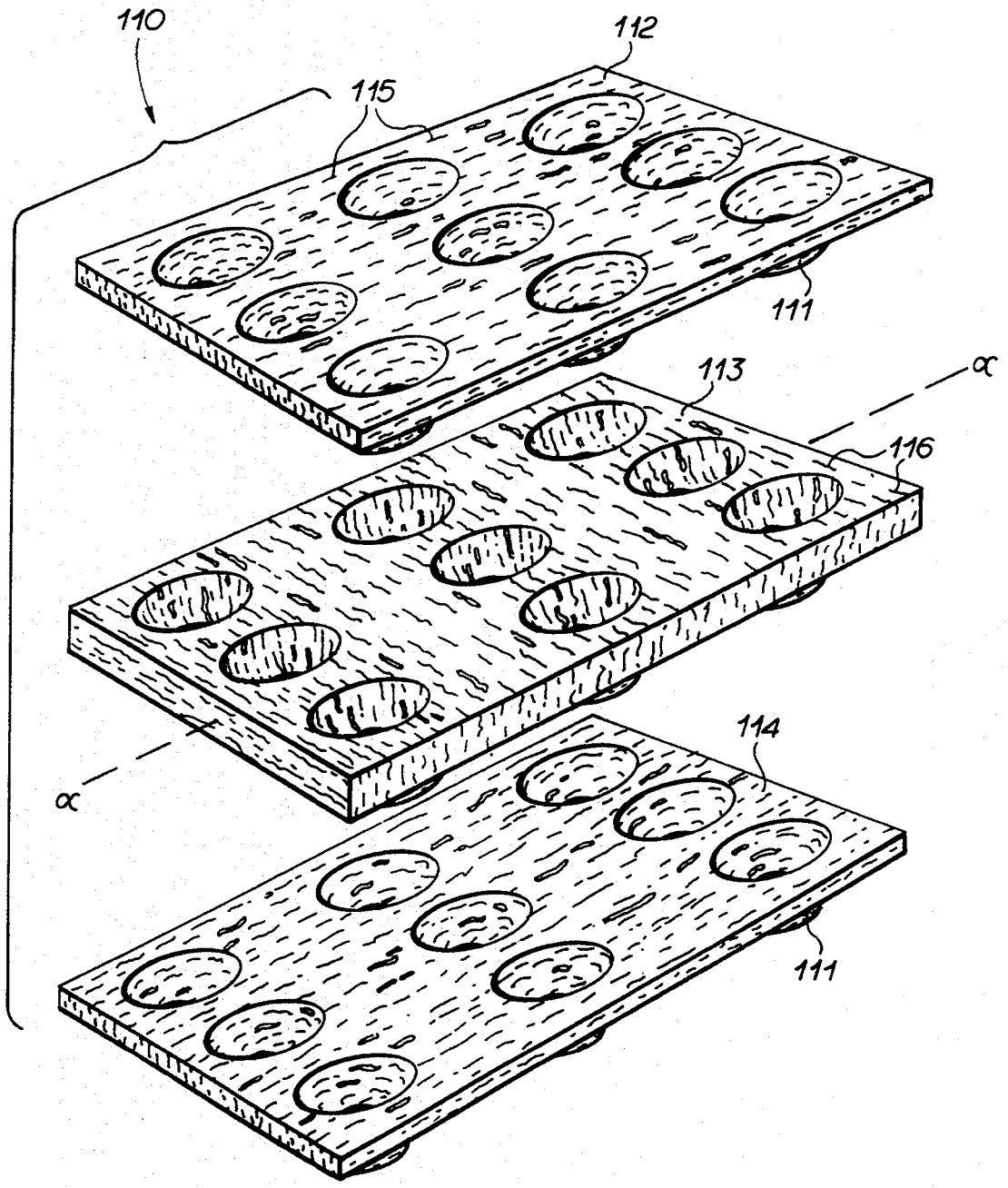
FIG. 3 is an exploded schematized representation of an article formed using one method of the present invention showing the various layers of the product.
Figure 5:
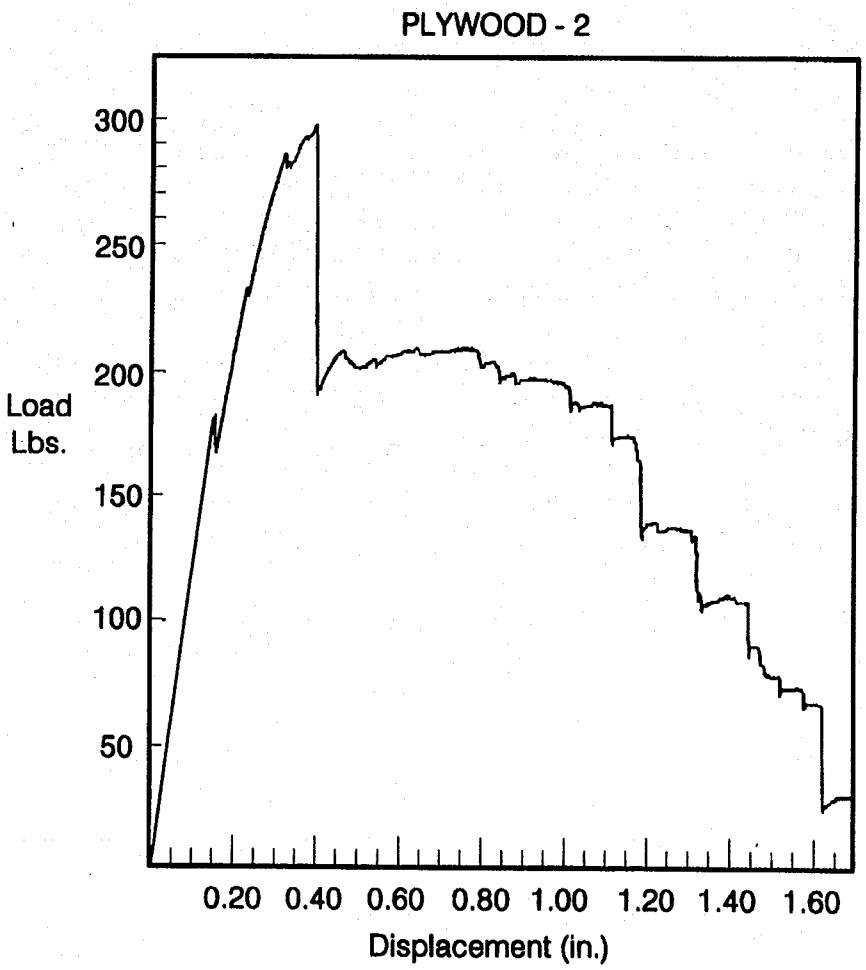
FIG. 5 is a load versus displacement graph showing results of load tests on a plywood sample using a three point tester.
Figure 4:
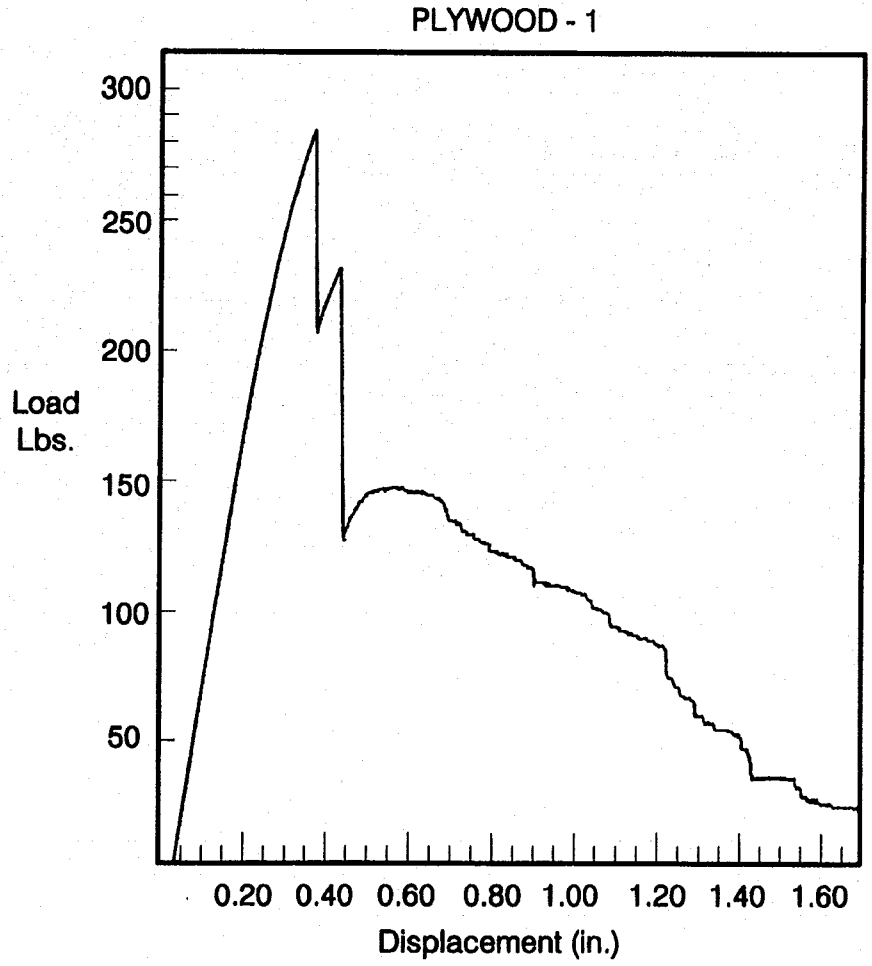
FIG. 4 is a load versus displacement graph showing results of load tests on a plywood sample using a three point tester.
Figure 7:
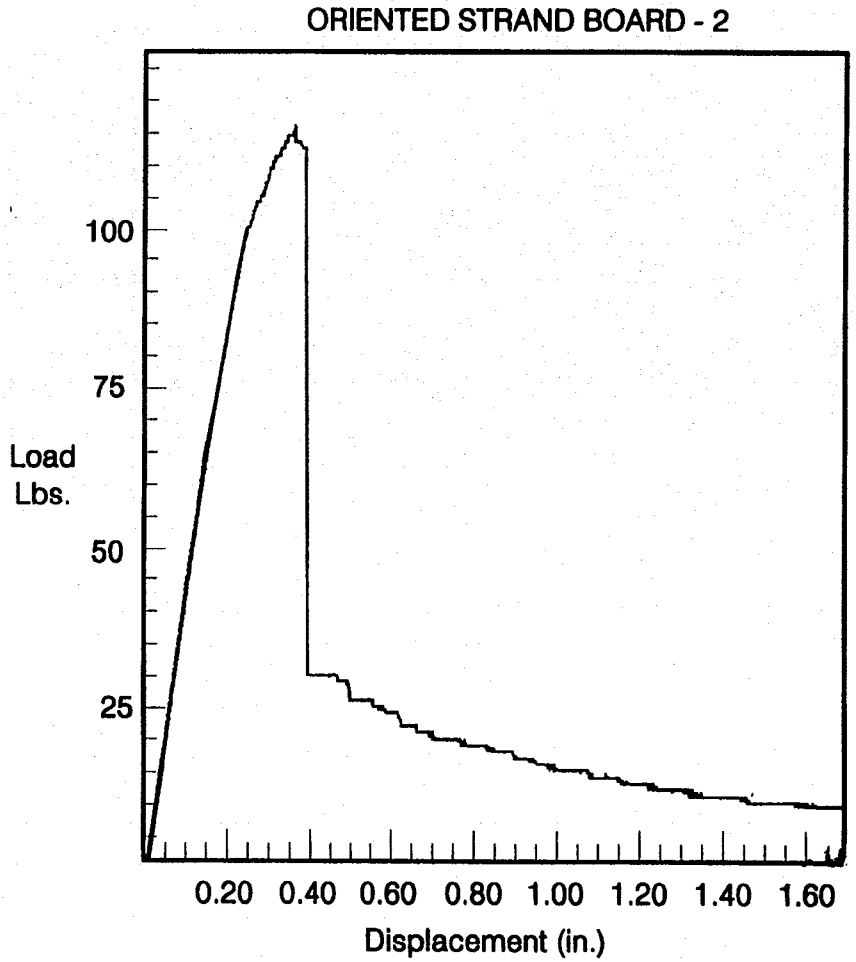
FIG. 7 is a load versus displacement graph showing results of load tests on an oriented strand board sample using a three point tester.
Figure 6:
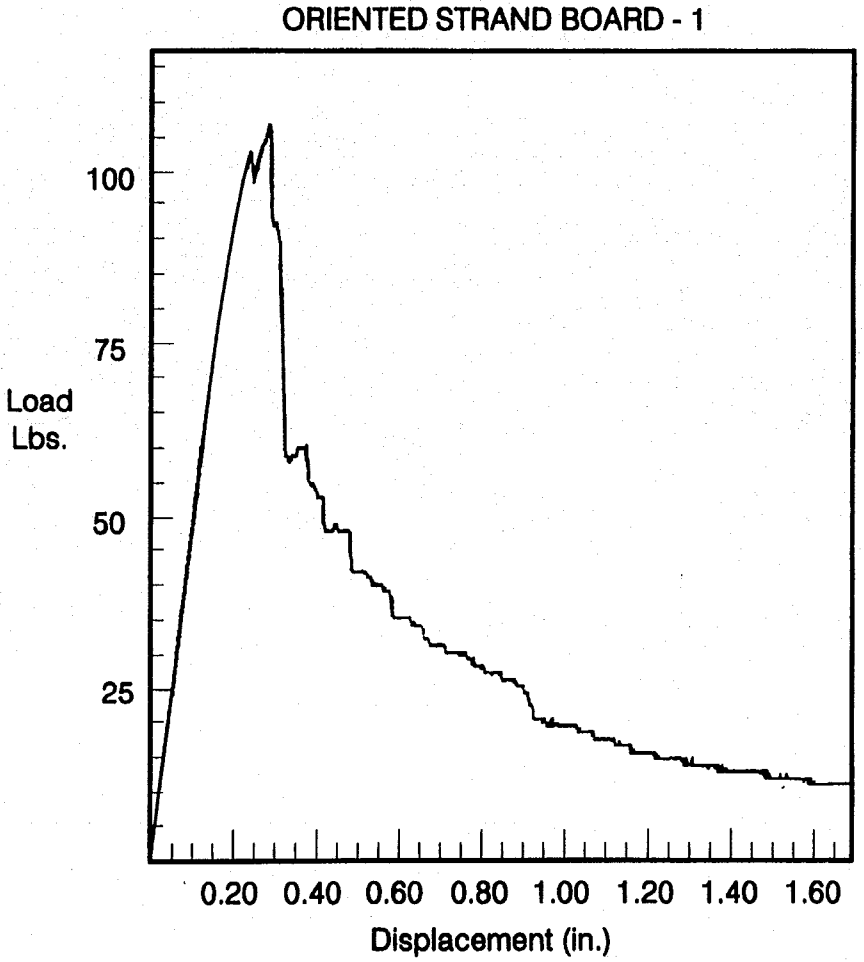
FIG. 6 is a load versus displacement graph showing results of load tests on an oriented strand board sample using a three point tester.
Figure 9:
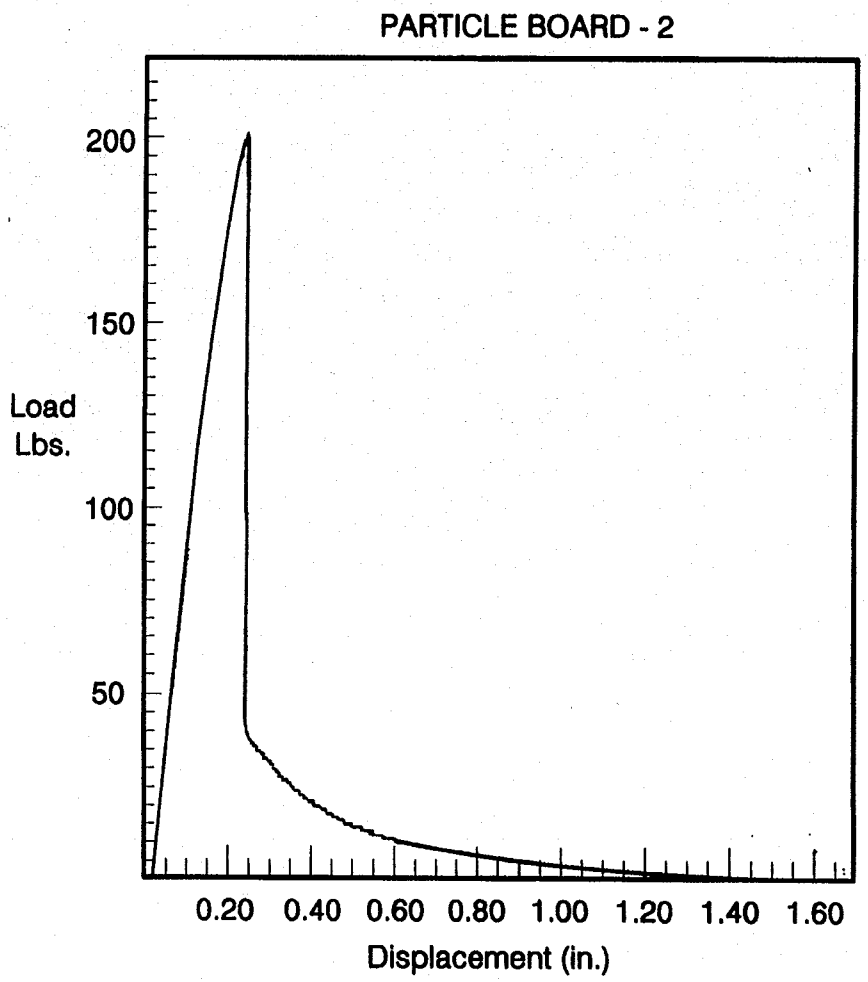
FIG. 9 is a load versus displacement graph showing results of load tests on a particleboard sample using a three point tester.
Figure 8:
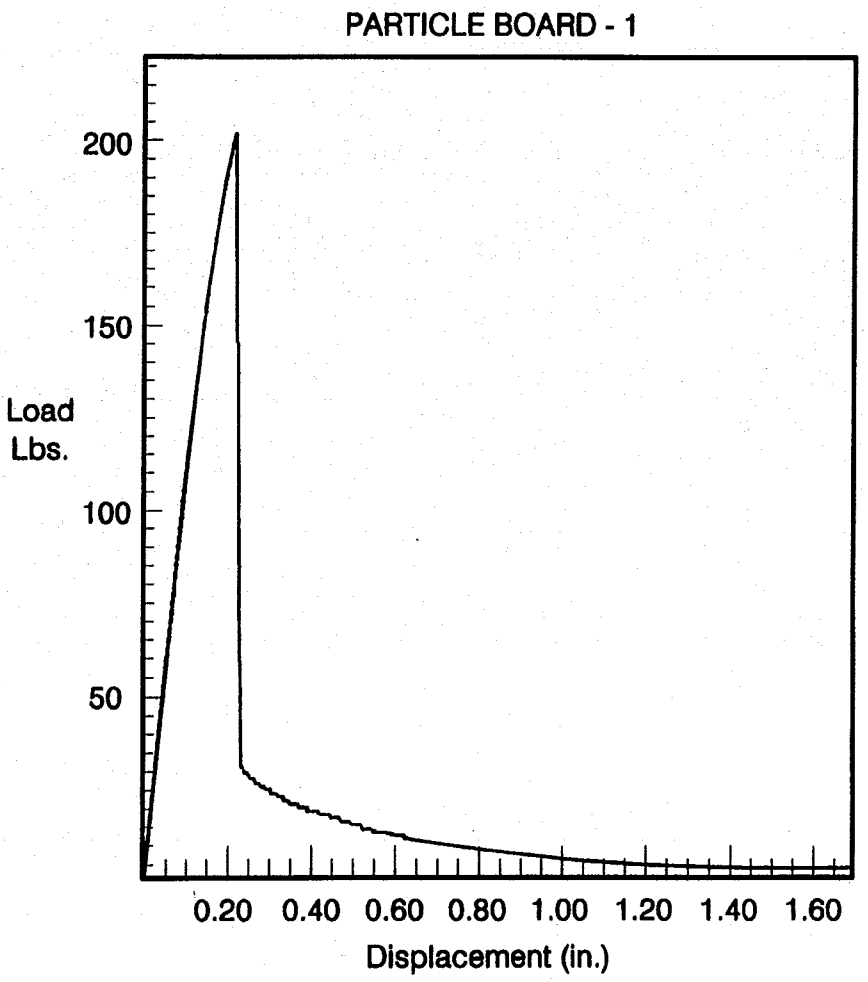
FIG. 8 is a load versus displacement graph showing results of load tests on a particleboard sample using a three point tester.

FIG. 3 shows a schematized fragmentary view of the three layers constituting the separate mats of pallet 110. Mat 112 includes long wood fibers 115 arranged along the longitudinal axis $\alpha$ of mat 110. Fibers 115 preferably are longer wood fibers 3 inches to 8 inches in length. Second or core mat 113 includes shorter fibers 116 arranged transversely to the direction of longer fibers 115. The bottom or compression layer 114 of mat 110 is substantially identical in composition and fiber alignment to that of mat 112. The reinforced composite mixture and process of forming article 110 is identical to that discussed above with respect to the process for forming an article having three layers.

Articles, such as pallets, manufactured in accordance with the present invention demonstrate superior strength characteristic than similar articles manufactured of known composite materials, such as plywood, oriented strand board and particleboard. Comparative tests were conducted on samples of plywood, OSB, particleboard and the "new product" of the present invention in order to determine the load at yield, stress at yield and the modulus of elasticity. The following table shows the test results:

| TEST NO. | SPECIMEN | LOAD @ YIELD | STRESS @ YIELD | YOUNG'S MODULUS | TYPE TEST |
|---|---|---|---|---|---|
| 1 | .5" PLYWOOD 5 PLY | 282.9 LBS. | 6686 PSI | 826,000 PSI | 3 PT. BENDING |
| 2 | .5" PLYWOOD 5 PLY | 295.7 LBS. | 6987 PSI | 986,700 PSI | 3 PT. BENDING |
| 3 | .5" OSB STRAND BD. | 107.3 LBS. | 2772 PSI | 465,700 PSI | 3 PT. BENDING |
| 4 | .5" OSB STRAND BD. | 117.3 LBS. | 2874 PSI | 431,800 PSI | 3 PT. BENDING |
| 5 | .5" PARTICLE BOARD | 201.8 LBS. | 2625 PSI | 388,800 PSI | 3 PT. BENDING |
| 6 | .5" PARTICLE BOARD | 200.9 LBS. | 2614 PSI | 408,700 PSI | 3 PT. BENDING |
| 7 Sample A | NEW PRODUCT .403" TK. | 646.5 LBS. | 19090 PSI | 1,332,000 PSI | 3 PT. BENDING |
| 8 Sample A | NEW PRODUCT .399" TK. | 327.7 LBS. | 10290 PSI | 670,000 PSI | 3 PT. BENDING |
| 9 Sample A | NEW PRODUCT .395" TK. | 512.1 LBS. | 15880 PSI | 1,060,000 PSI | 3 PT. BENDING |
| 10 Sample A | NEW PRODUCT .403" TK. | 670.7 LBS. | 19380 PSI | 1,330,000 PSI | 3 PT. BENDING |
| MEAN Sample A | NEW PRODUCT | 539.2 LBS. | 16270 PSI | 1,096,000 PSI | 3 PT. BENDING |
| 11 Sample B | NEW PRODUCT .403" TK. | 512.8 LBS. | 15350 PSI | 973,700 PSI | 3 PT. BENDING |
| 12 Sample 8 | NEW PRODUCT .399" TK. | 482.9 LBS. | 14290 PSI | 942,200 PSI | 3 PT. BENDING |
| 13 Sample B | NEW PRODUCT .395" TK. | 348.0 LBS. | 11110 PSI | 906,300 PSI | 3 PT. BENDING |
| 14 Sample B | NEW PRODUCT .403" TK. | 357.1 LBS. | 11240 PSI | 1,012,000 PSI | 3 PT. BENDING |
| MEAN Sample B | NEW PRODUCT | 425.1 LBS. | 13000 PSI | 958,400 PSI | 3 PT. BENDING |
| 15 Sample C | NEW PRODUCT .371" TK. | 295.8 LBS. | 10390 PSI | 930,300 PSI | 3 PT. BENDING |
| 16 Sample C | NEW PRODUCT .382" TK. | 402.0 LBS. | 13910 PSI | 1,065,000 PSI | 3 PT. BENDING |
| 17 Sample C | NEW PRODUCT .392" TK. | 484.9 LBS. | 15190 PSI | 1,143,000 PSI | 3 PT. BENDING |
| 18 Sample C | NEW PRODUCT .413" TK. | 523.3 LBS. | 14670 PSI | 959,800 PSI | 3 PT. BENDING |
| MEAN Sample C | NEW PRODUCT | 426.5 LBS. | 13540 PSI | 1,025,000 PSI | 3 PT. BENDING |

Figure 10:
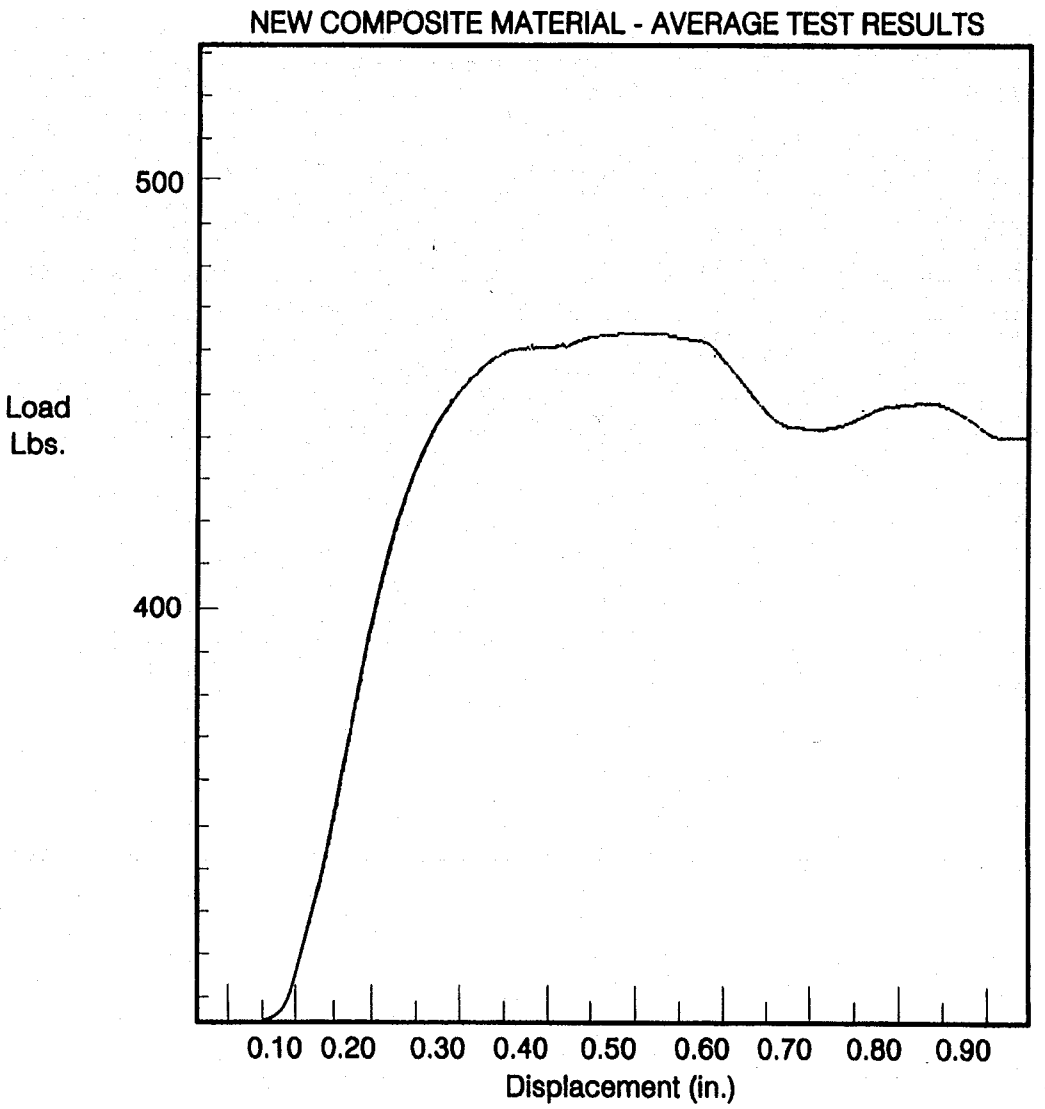
FIG. 10 is a load versus displacement graph showing an average of the results of numerous load tests using a three point tester on samples of composite material made in accordance with the present invention.

The tests were conducted using ASTM three point testing methods. Two tests were conducted, each on specimens of plywood, OSB and particleboard, respectively. The above table reflects the test results for these known materials, in which each side of a sample of the material was tested. The remaining test results reflect tests conducted on three samples of the composite product of the present invention. Sample A was comprised of the component materials listed above in Example D, test No. V (long thick flakes and thin long flakes). Sample B was comprised of the following component materials: wood 60%, plastic 39%, coupler 1%. Sample C was comprised of the following component materials: wood 59%, plastic 39%, coupler 2%. Four tests were conducted on each sample of the product of the present invention. The test results show that the modulus of elasticity for the new product is between 958,400 psi and 1,096,008 psi. This compares to a range of 826,000 to 986,700 psi for plywood and a range of 465,700–431,800 psi for oriented strand board. Additionally, the products of the present invention are substantially impervious to water, and therefore are not as susceptible to weakening caused by moisture as is plywood, particleboard, OSB and lumber. FIGS. 4–9 graphically illustrate the results of tests 1–6, respectively, listed above. FIG. 10 graphically shows the average test results for all tests conducted on Sample A, Sample B and Sample C, listed above. The test results demonstrate that the products made in accordance with the present invention do not abruptly leave strength characteristics after failure. These characteristics are quite desirable in the application of the present invention listed above, such as use in material handling of pallets.

Also as discussed above, many variations may be had with respect to the process and the articles formed thereby by modifying the above-described variables to produce articles having predetermined but different physical properties. Therefore, while the invention has been disclosed in preferred forms only, it will be obvious to those skilled in the art that many additions, deletions and modifications can be made therein without departing from the spirit and the scope of the invention as set forth in the following claims.

Wherefore, the following is claimed:

1. A method of forming an article of composite material using a preformed mold, comprising the steps of:

(a) blending cellulosic flakes of essentially a first size with plastic particles of essentially a second size to produce a composite mixture;

(b) depositing at least a portion of said composite mixture onto said mold to form a mat of composite mixture on said mold; and (c) applying heat and pressure on said mat sufficient to remelt said plastic particles and to cause said mat to substantially assume the form of said proformed mold;

wherein said plastic particles comprise particles of a thermoplastic material.

2. The method of claim 1, and aligning said cellulosic flakes within said composite mixture in a predetermined direction prior to step (c).

3. The method of claim 1, and adding a coupling agent to said composite mixture prior to step (a).

4. The method of claim 1, and adding a coupling agent to said composite mixture prior to step (b).

5. The method of claim 1, and adding fiberglass to said composite mixture prior to step (b).

6. A method of forming an article of composite material using a preformed mold, comprising the steps of:

(a) comminuting a cellulosic structure into flakes of cellulosic fibers of essentially a first size;

(b) comminuting plastic into granules of essentially a second size;

(c) blending said flakes and said granules with a coupling agent to produce a first composite mixture;

(d) depositing a predetermined quantity of said first composite mixture onto said mold and orienting said flakes in a selected direction to form a first mat comprising said first composite mixture onto said mold; and (e) applying heat and pressure on said first mat sufficient to remelt said plastic granules and to cause said first mat substantially to assume the form of said preformed mold;

wherein said plastic comprises a thermoplastic material.

7. The method of claim 6, and blending additional flakes of cellulosic fibers and additional plastic granules to form a second composite mixture and depositing a predetermined quantity of said second composite mixture onto said first mat to form a second mat comprising said second composite mixture, prior to step (e).

8. The method of claim 7, and depositing a predetermined quantity of said first composite mixture onto said second mat and orienting said flakes in said selected direction to form a third mat, prior to step (e).

9. The method of claim 1, wherein said thermoplastic material is selected from a group consisting of high density polyethylene, polyvinyl chloride, polypropylene, low density polyethylene, and polystyrene.

10. The method of claim 6, wherein said thermoplastic material is selected from a group consisting of high density polyethylene, polyvinyl chloride, polypropylene, low density polyethylene, and polystyrene.

11. The method of claim 1, wherein said first size is greater than approximately 3/16 of an inch and said second size is approximately ⅛ of an inch.

12. The method of claim 1, wherein said first size is greater than approximately 3 inches and said second size is approximately ⅛ of an inch.

13. The method of claim 1, further comprising the step of adding a wax to said composite mixture.

14. The method of claim 1, wherein said first size is equal to said second size.

15. The method of claim 6, wherein said first size is greater than approximately 3/16 of an inch and said second size is approximately ⅛ of an inch.

16. The method of claim 6, wherein said first size is greater than approximately 3 inches and said second size is approximately ⅛ of an inch.

17. The method of claim 6, further comprising the step of adding a wax to said first composite mixture.

18. The method of claim 6, wherein said first size is equal to said second size.

19. A method for producing a load bearing product, comprising the steps of:

(a) blending cellulosic flakes of a first size with plastic granules of a first type to form a mixture having a first ratio of cellulosic flakes to plastic granules;

(b) aligning said flakes in essentially a first direction;

(c) depositing said first mixture onto a preformed mold to form a first layer of said load bearing product;

(d) blending cellulosic flakes of a second size with plastic granules of a second type to form a second mixture having a second ratio of cellulosic flakes to plastic granules, said second type of plastic granules being different than said first type;

(e) aligning said flakes in essentially a second direction which is transverse to said first direction;

(f) depositing said second mixture onto said first layer to form a second layer of said load bearing product;

(g) aligning said flakes in said first mixture to be essentially along said first direction; and (h) depositing said first mixture onto said second layer of said load bearing product to form a third layer of said load bearing product;

(i) applying heat and pressure to the first, second, and third layers of said load bearing product sufficient to remelt said plastic granules of the first and second types and to cause the first, second, and third layers to assume a shape of said preformed mold;

wherein said plastic granules of said first type and said second type both comprise a thermoplastic material.

20. The method as set forth in claim 19, wherein said first size of said flakes is in a range of about 3 inches to 8 inches and said second size of flakes is in a range of about 3/16 of an inch to 3 inches.

21. The method as set forth in claim 19, wherein said first type of plastic granules comprises a high strength plastic and said second type of plastic granules comprises a low strength plastic.

22. (Newly Added) The method as set forth in claim 19, wherein said first ratio is about 60% of said flakes to 37% of said plastic granules.

23. The method as set forth in claim 19, wherein said first layer and said third layer each comprises about 25% of said load bearing product and said second layer comprises about 50% of said load bearing product.

24. A method of forming an article of composite material using a preformed mold, comprising the steps of:

(a) comminuting a pre-processed cellulosic structure into flakes of essentially a first size;

(b) comminuting a thermo-plastic into granules of essentially a second size;

(c) blending said flakes and said granules with a coupling agent to produce a composite mixture;

(d) depositing said composite mixture onto said mold; and (e) applying heat and pressure sufficient to remelt said granules and to cause said composite mixture to assume the form of said preformed mold to thereby form said article of composite material.

25. The method as set forth in claim 24, further comprising the step of comminuting virgin wood into flakes of said first size.

26. The method as set forth in claim 24, further comprising the step of aligning said flakes in essentially a first direction.

27. The method as set forth in claim 24, further comprising the steps of comminuting said pre-processed cellulosic structure into flakes of essentially a third size and separating said flakes of said third size from said flakes of said first size.

28. The method as set forth in claim 27, wherein said steps of comminuting said pre-processed cellulosic structure into said flakes of said first size and said third size comprise the steps of comminuting said flakes to said first size of about 3 inches to 8 inches and comminuting said flakes to said third size of about 3/16 of an inch to 3 inches.

29. The method as set forth in claim 24, further comprising the steps of comminuting a second thermoplastic into granules of essentially said second size, said second thermo-plastic being of a different strength than said first thermo-plastic.

30. The method as set forth in claim 24, further comprising the step of removing pieces of metal from said flakes of cellulosic structure.

* * * * *